US009421774B2

(12) United States Patent
Tsunemi et al.

(10) Patent No.: US 9,421,774 B2
(45) Date of Patent: Aug. 23, 2016

(54) INKJET RECORDING APPARATUS AND RECORDING HEAD MAINTENANCE METHOD

(71) Applicant: KYOCERA Document Solutions Inc., Osaka (JP)

(72) Inventors: Satoshi Tsunemi, Osaka (JP); Shinji Yoshinaga, Osaka (JP); Takeshi Watanabe, Osaka (JP); Hiroatsu Tamai, Osaka (JP); Hidenori Takenaka, Osaka (JP); Jumpei Hobo, Osaka (JP); Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/006,613

(22) Filed: Jan. 26, 2016

(65) Prior Publication Data

US 2016/0214385 A1 Jul. 28, 2016

(30) Foreign Application Priority Data

Jan. 27, 2015 (JP) ..... 2015-013302

(51) Int. Cl.
*B41J 2/165* (2006.01)
*B41J 11/00* (2006.01)

(52) U.S. Cl.
CPC ..... *B41J 2/165* (2013.01); *B41J 2/16505* (2013.01); *B41J 2/16535* (2013.01); *B41J 2/16585* (2013.01); *B41J 11/003* (2013.01); *B41J 11/0095* (2013.01)

(58) Field of Classification Search
CPC .. B41J 2/165; B41J 2/16585; B41J 2/16535; B41J 2/16505; B41J 11/0095; B41J 11/003
See application file for complete search history.

(56) References Cited

U.S. PATENT DOCUMENTS

2009/0122106 A1* 5/2009 Ray ..... B41J 2/165 347/35
2012/0113183 A1* 5/2012 Ikeda ..... B41J 2/2142 347/19
2014/0292869 A1* 10/2014 Mizutani ..... B41J 2/16526 347/14

FOREIGN PATENT DOCUMENTS

JP 2011-105451 A 6/2011

* cited by examiner

*Primary Examiner* — Jason Uhlenhake
(74) *Attorney, Agent, or Firm* — Studebaker & Brackett PC

(57) ABSTRACT

An inkjet recording apparatus includes a conveyance section, a recording head, a maintenance mechanism, and a control section. The conveyance section conveys a recording medium. The recording head discharges ink droplets toward the recording medium while the conveyance section conveys the recording medium. The maintenance mechanism performs maintenance on the recording head. The control section causes the maintenance mechanism to operate upon determination that a width of a next recording target recording medium is greater than a width of a recording medium subjected to image recording prior to the next recording target recording medium.

7 Claims, 24 Drawing Sheets

INKJET RECORDING APPARATUS AND RECORDING HEAD MAINTENANCE METHOD

INCORPORATION BY REFERENCE

The present application claims priority under 35 U.S.C. §119 to Japanese Patent Application No. 2015-013302, filed on Jan. 27, 2015. The contents of this application are incorporated herein by reference in their entirety.

BACKGROUND

The present disclosure relates to inkjet recording apparatuses and recording head maintenance methods.

Inkjet recording apparatuses are widely used in printers, copiers, multifunction peripherals, etc. An inkjet recording apparatus discharges ink droplets from nozzle orifices in a recording head to record an image on a recording medium. Specifically, the inkjet recording apparatus conveys a recording medium such as a sheet of paper so that the recording medium passes over a location opposite to the recording head. The recording head discharges ink droplets toward the recording medium while the recording medium is conveyed. Thus, the image is recorded on the recording medium.

In the inkjet recording apparatus, foreign matter on a recording medium may be attached to the nozzle orifices of the recording head. The nozzle orifices to which the foreign matter is attached may be disabled to discharge ink droplets. The foreign matter may be paper dust, for example. A phenomenon in which a nozzle orifice is disabled to discharge ink droplets is referred to as discharge disablement. In a situation in which discharge disablement occurs, an image including a white line may be formed, resulting in reduction in image quality.

An inkjet recording apparatus including a scraping member is proposed in order to obviate the above problem. The scraping member is disposed in a sheet feed passage that guides a recording medium from a feed section (sheet feed section) to a recording performing region (conveyance section). The scraping member comes in contact with a recording surface of the recording medium while the recording medium is fed, thereby removing foreign matter such as paper dust attached to the recording surface. The above configuration can reduce an amount of foreign matter conveyed below a recording head to reduce occurrence of discharge disablement. Thus, reduction in image quality can be prevented.

SUMMARY

An inkjet recording apparatus according to the present disclosure performs image recording on a recording medium by discharging ink droplets. The inkjet recording apparatus includes a conveyance section, a recording head, a maintenance mechanism, and a control section. The conveyance section conveys a recording medium in a first direction. The recording head discharges ink droplets toward the recording medium while the conveyance section conveys the recording medium. The maintenance mechanism performs maintenance on the recording head. The control section controls the maintenance mechanism. The control section causes the maintenance mechanism to operate upon determination that a width of a next recording target recording medium in a second direction perpendicular to the first direction is greater than a width of a recording medium subjected to image recording prior to the next recording target recording medium in the second direction.

A first recording head maintenance method according to the present disclosure is a method for performing maintenance on a recording head that discharges ink droplets toward a recording medium being conveyed in a first direction. The method includes: determining whether or not a width of a next recording target recording medium in a second direction perpendicular to the first direction is greater than a width of a recording medium in the second direction subjected to image recording prior to the next recording target recording medium; and upon determination that the width of the next recording target recording medium is greater than the width of the recording medium subjected to image recording prior to the next recording target recording medium, performing maintenance on the recording head.

A second recording head maintenance method according to the present disclosure is a method for performing maintenance on a recording head that discharges ink droplets toward a recording medium being conveyed in a first direction. The method includes: determining whether or not a width of a next recording target recording medium in a second direction perpendicular to the first direction is greater than a width of a recording medium in the second direction subjected to image recording prior to the next recording target recording medium; upon determination that the width of the next recording target recording medium is greater than the width of the recording medium in the second direction subjected to image recording prior to the next recording target recording medium, determining whether or not image recording has been performed on a predetermined number or more of recording mediums having a width smaller than the width of the next recording target recording medium in the second direction prior to the next recording target recording medium; and upon determination that image recording has been performed on the predetermined number or more of recording mediums having the width smaller than the width of the next recording target recording medium prior to the next recording target recording medium, performing maintenance on the recording head.

DETAILED DESCRIPTION

Figure 1:
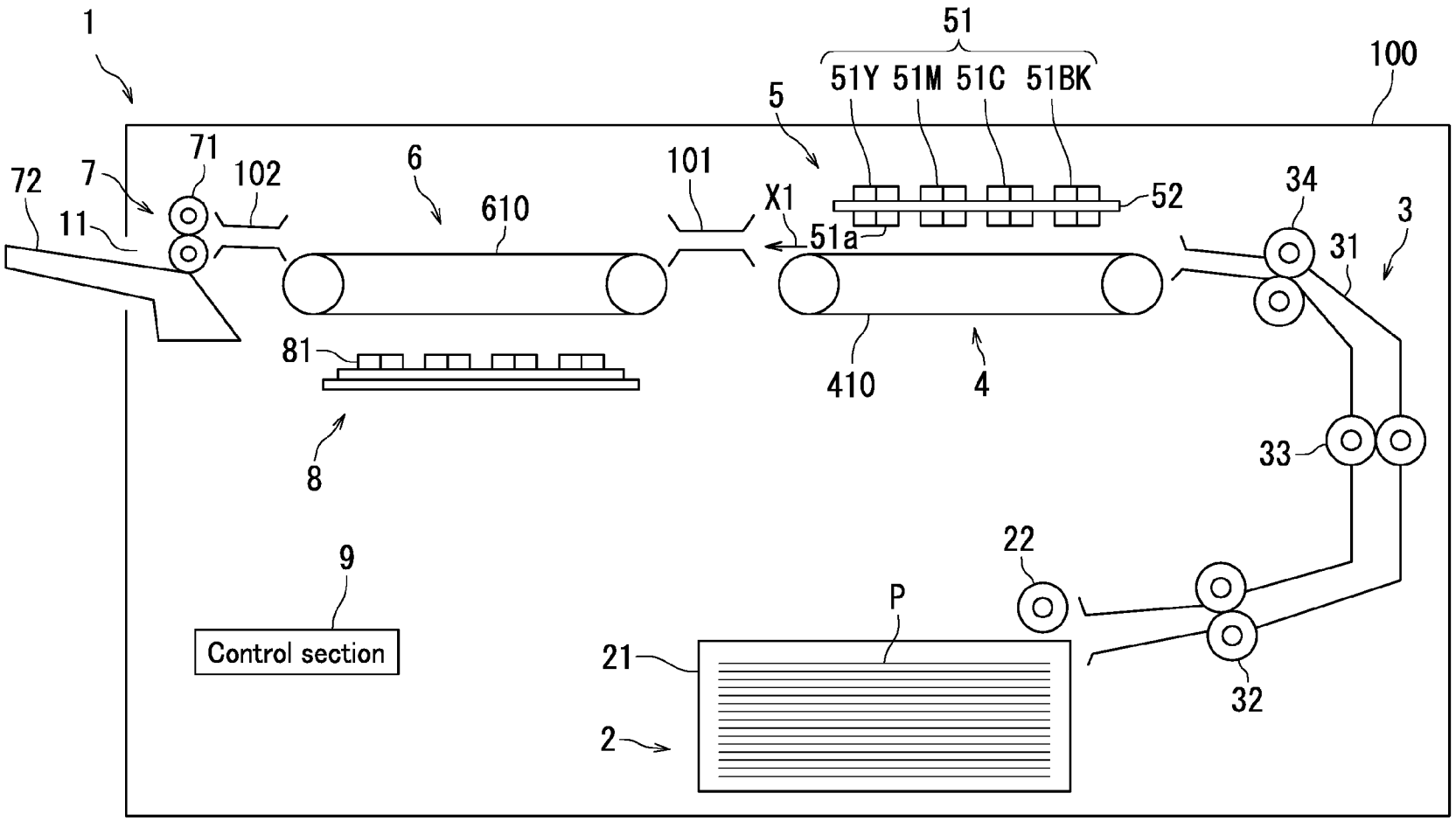
FIG. 1 illustrates structure of an inkjet recording apparatus according to a first embodiment.

Embodiments of the present disclosure will be described below with reference to the accompanying drawings. Like numerals denote like elements or corresponding elements in the drawings, and description thereof is not repeated. The drawings are schematic illustrations that emphasize elements of configuration in order to facilitate understanding thereof. Also note that material properties, shapes, dimensions, and the like, described for each of the elements of configuration in the following embodiments, are only examples and are not intended to impose any particular limitations on the elements.

First Embodiment

With reference to FIG. 1, description will be made first about an inkjet recording apparatus 1 according to the present embodiment. FIG. 1 illustrates structure of the inkjet recording apparatus 1. Specifically, FIG. 1 illustrates a state in which the inkjet recording apparatus 1 performs image recording on a sheet P that is an example of a recording medium. The inkjet recording apparatus 1 discharges ink droplets to record an image on a sheet P.

The inkjet recording apparatus 1 includes an apparatus housing 100, a sheet feed section 2, a sheet conveyance path 3, a first conveyance section 4, a recording section 5, a second conveyance section 6, a sheet ejecting section 7, a wiping unit 8, a control section 9, a first conveyance guide 101, and a second conveyance guide 102.

The sheet feed section 2 feeds a sheet P to the sheet conveyance path 3. The sheet feed section 2 includes a sheet feed roller 22 and a sheet feed cassette 21 attachable to and detachable from the apparatus housing 100. The sheet feed roller 22 is disposed above one end (right end in FIG. 1) of the sheet feed cassette 21.

The sheet feed cassette 21 is capable of being loaded with a plurality of sheets P. The sheet feed roller 22 (pickup roller) picks up a sheet P from the sheet feed cassette 21 one at a time and feeds the sheet P toward the sheet conveyance path 3.

The sheet conveyance path 3 guides the sheet P to the first conveyance section 4. The sheet conveyance path 3 is constituted by guide plates 31. The sheet conveyance path 3 includes a first pair of conveyance rollers 32, a second pair of conveyance rollers 33, and a pair of registration rollers 34. The first pair of conveyance rollers 32 is disposed around an inlet of the sheet conveyance path 3. The second pair of conveyance rollers 33 is disposed partway along the sheet conveyance path 3. The pair of registration rollers 34 is disposed around an outlet of the sheet conveyance path 3.

The first pair of conveyance rollers 32 sandwiches the sheet P fed from the sheet feed section 2 and forwards the sheet P toward the second pair of conveyance rollers 33. The second pair of conveyance rollers 33 sandwiches the sheet P forwarded from the first pair of conveyance rollers 32 and forwards the sheet P toward the pair of registration rollers 34.

The pair of registration rollers 34 performs skew correction on the sheet P having been forwarded by the second pair of conveyance rollers 33. The pair of registration rollers 34 synchronizes image recording on the sheet P with conveyance of the sheet P toward the first conveyance section 4. Specifically, the pair of registration rollers 34 temporarily holds the sheet P and then feeds the sheet P toward the first conveyance section 4 according to timing of the image recording on the sheet P. More specifically, the sheet P comes in contact with the pair of registration rollers 34 and stops. Through the contact, skew correction is performed on the sheet P. The pair of registration rollers 34 then feeds the sheet P toward the first conveyance section 4 according to timing of the image recording on the sheet P.

The first conveyance section 4 is located directly below the recording section 5 in image recording on the sheet P. The first conveyance section 4 conveys the sheet P forwarded from the pair of registration rollers 34 toward the first conveyance guide 101.

The first conveyance section 4 includes a first conveyor belt 410. The first conveyor belt 410 is an endless belt. The sheet P fed by the pair of registration rollers 34 is guided onto the first conveyor belt 410. The first conveyance section 4 causes the sheet P to be sucked on the first conveyor belt 410. Through the suction, the sheet P is held on the first conveyor belt 410. The first conveyance section 4 circulates the first conveyor belt 410 in a predetermined rotation direction (anticlockwise direction in FIG. 1). Circulation of the first conveyor belt 410 conveys the sheet P in a direction indicated by an arrow X1 (sub-scanning direction). The first conveyance section 4 accordingly conveys the sheet P in a predetermined direction that is an example of a first direction. Hereinafter, the direction in which the sheet P is conveyed by the first conveyance section 4 (first conveyor belt 410) is referred to as a sheet conveyance direction X1.

The recording section 5 discharges ink droplets toward the sheet P while the first conveyance section 4 conveys the sheet P, thereby recording an image on the sheet P. The recording section 5 includes line heads 51Bk, 51C, 51M, and 51Y. The recording section 5 further includes a head base 52. The line head 51Bk discharges droplets of black ink. The line head 51C discharges droplets of cyan ink. The line head 51M discharges droplets of magenta ink. The line head 51Y discharges droplets of yellow ink. The line heads 51Bk, 51C, 51M, and 51Y have the same configuration and therefore may be referred to as line heads 51.

The line heads 51 are supported by the head base 52. The line heads 51 discharge ink droplets toward the sheet P while the first conveyance section 4 (first conveyor belt 410) conveys the sheet P. As a result, an image is recorded on the sheet P. Specifically, the line heads 51 discharge ink droplets toward the sheet P passing over a location opposite to the line heads 51. As a result, an image including a character or a figure is recorded on the sheet P.

The first conveyance guide 101 is disposed between the first conveyance section 4 and the second conveyance section 6. The first conveyance guide 101 guides the sheet P forwarded from the first conveyance section 4 to the second conveyance section 6.

The second conveyance section 6 conveys the sheet P forwarded from the first conveyance section 4 toward the second conveyance guide 102. The second conveyance section 6 includes a second conveyor belt 610. The second conveyor belt 610 is an endless belt. The sheet P forwarded from the first conveyance section 4 is guided onto the second conveyor belt 610. The second conveyance section 6 causes the sheet P to be sucked on the second conveyor belt 610. Through the suction, the sheet P is held on the second conveyor belt 610. The second conveyance section 6 circulates the second conveyor belt 610 in a predetermined rotation direction (anticlockwise direction in FIG. 1). Circulation of the second conveyor belt 610 conveys the sheet P toward the second conveyance guide 102.

The second conveyance guide 102 is disposed between the second conveyance section 6 and the sheet ejecting section 7. The second conveyance guide 102 guides the sheet P forwarded from the second conveyance section 6 to the sheet ejecting section 7.

The sheet ejecting section 7 ejects the sheet P outside the apparatus housing 100. The sheet ejecting section 7 includes a pair of ejection rollers 71 and an exit tray 72. The exit tray 72 is secured to the apparatus housing 100 so as to protrude outward from an exit port 11 formed in the apparatus housing 100. The exit port 11 is formed in one side surface of the apparatus housing 100 (left side surface in FIG. 1).

The pair of ejection rollers 71 forwards the sheet P having passed through the second conveyance guide 102 in a direction toward the exit port 11. The sheet P forwarded by the pair of ejection rollers 71 is guided by the exit tray 72 to be ejected outside the apparatus housing 100 through the exit port 11. The sheet P ejected outside the apparatus housing 100 is placed on the exit tray 72. In a situation in which image recording is performed successively on a plurality of sheets P, the sheets P are stacked on the exit tray 72.

The wiping unit 8 is located below the second conveyance section 6 in image recording on the sheet P. The wiping unit 8 includes a plurality of wiper blades 81. The wiper blades 81 are cleaning members for cleaning respective nozzle surfaces 51*a* of the line heads 51. The nozzle surfaces 51*a* of the line heads 51 face the first conveyance section 4 (first conveyor belt 410) in image recording on the sheet P. The nozzle surfaces 51*a* each have a plurality of nozzle orifices (not illustrated) from which ink droplets are discharged. The wiping unit 8 moves directly below the recording section 5 in maintenance on the line heads 51 and wipes the nozzle surfaces 51*a* using the wiper blades 81.

The control section 9 has a storage region. The storage region stores therein programs, setting information, etc. The storage region is constituted by a magnetic disk of a hard disk drive (HDD), a random access memory (RAM), a read only memory (ROM), etc. The control section 9 executes programs stored in advance in the storage region to control respective elements in the inkjet recording apparatus 1.

Various air flows are created in the interior of the apparatus housing 100 of the inkjet recording apparatus 1 in image recording on a sheet P. For example, the first conveyance section 4 sucks the sheet P onto the first conveyor belt 410. This creates an air flow from above the first conveyor belt 410 toward the inner side of the first conveyor belt 410. Conveyance of the sheet P creates an air flow in the sheet conveyance direction X1. As a result, the sheet P passes below the line heads 51 while receiving wind. A space between the line heads 51 and the first conveyor belt 410 is narrow. Therefore, comparative strong wind is likely to be created between the line heads 51 and the first conveyor belt 410. In the above configuration, foreign matter such as paper dust attached to the sheet P tends to be blown away (flying up) by the wind below the line heads 51. For this reason, the foreign matter blown away from the sheet P may be attached to the nozzle orifices of the line heads 51. Foreign matter such as paper dust attached to the nozzle orifices may cause discharge disablement. The discharge disablement may cause an image including a white line to be formed, thereby reducing image quality.

Foreign matter such as paper dust may be charged. For this reason, in a situation in which an electric field is generated between an element of the first conveyance section 4 and the line heads 51, the foreign matter may fly due to the presence of the electric field to be attracted to the line heads 51. As a result, foreign matter such as paper dust may be attached to the nozzle orifices in the line heads 51.

The inkjet recording apparatus 1 in the present embodiment performs maintenance on the line heads 51 after image recording on a predetermined number of sheets P (3000 sheets in the present embodiment). The inkjet recording apparatus 1 in the present embodiment performs maintenance on the line heads 51 also at initiation of the inkjet recording apparatus 1 (at power-up and return from a sleep state). Hereinafter, the maintenance performed at the above timing is referred to as regular maintenance.

In a situation in which image recording is performed successively on multiple sheets P having the same size, discharge disablement may occur before execution of the regular maintenance. Specifically, much paper dust is present on the end part (edge) of a sheet P, and therefore, discharge disablement may occur in a region outside a region through which multiple sheets P having the same size have passed. For the reason as above, an image formed on a next recording target sheet P may include a white line in a situation in which the next recording target sheet P has a width in a direction perpendicular to the sheet conveyance direction X1 (direction perpendicular to the drawing surface in FIG. 1) greater than a width of the multiple sheets P previously subjected to image recording in the direction perpendicular to the sheet conveyance direction X1. Hereinafter, the width in the direction (an example of a second direction) perpendicular to the sheet conveyance direction X1 is referred simply to a "width". The reason why much paper dust is present on the end part (edge) of a sheet P is that chips (paper dust) are attached to the end part of the sheet P through a production process of the sheet P (sheet making process). Chips are generated at a section of a sheet P in sheet cutting.

In order to tackle the above problem, the inkjet recording apparatus 1 in the present embodiment performs maintenance on the line heads 51 upon receiving a request for image recording on a next recording target sheet P. Specifically, maintenance is performed on the line heads 51 in a situation in which the number of sheets P having a width smaller than that of the next recording target sheet P is no less than a predetermined value (100 in the present embodiment) among sheets P subjected to image recording before image recording on the next recording target sheet P is requested. Hereinafter, maintenance performed at the above timing is referred to as sheet width dependent maintenance. The number of sheets P having a width smaller than that of the next recording target sheet P is referred to as a total number of small sheets P. The small sheets P are included among sheets P subjected to image recording before image recording on the next recording target sheet P is requested. The sheet width dependent maintenance is performed before image recording on the next recording target sheet P.

According to the present embodiment, in a situation in which the width of the next recording target sheet P is greater than that of a sheet P previously subjected to image recording, the sheet width dependent maintenance (maintenance on the line head 51) is performed. Thus, an image formed on the next recording target sheet P is unlikely to include a white line. Reduction in image quality can be accordingly prevented.

The control section 9 controls execution timing of the sheet width dependent maintenance based on information contained in a print request requesting image printing on a sheet P or information contained in a print job. Specifically, the control section 9 determines the width of a sheet P based on information on sheet size, orientation, etc. of a recording target sheet P. The control section 9 also determines whether or not the total number of small sheets P is no less than the predetermined number based on information on the number of pages of an original document that is a printing target, the number of printing copies, etc.

The total number of small sheets P may amount to no less than the predetermined number through execution of a single print job. Alternatively, the total number of small sheets P may amount to no less than the predetermined number through execution of a plurality of print jobs. In view of the foregoing, the control section 9 in the present embodiment calculates the total number of small sheets P each time a print job is executed. The calculated total number is stored in the storage region. When maintenance is performed on the line heads 51, the control section 9 resets the total number of small sheets P stored in the storage region. Note that the predetermined number is not limited to 100. It is only required that the predetermined number is an integer equal to or greater than one. The predetermined number may be a parameter value optionally settable by a user.

Specifically, maintenance on the line heads 51 is executed through purge and wipe. The purge and wipe is a process of purging followed by wiping. The purging is an operation to supply ink to the line heads 51 and forcedly extrude (purge) ink from the nozzle orifices of the line heads 51. The wiping is an operation to wipe the nozzle surfaces 51*a* of the line heads 51 by the wiper blades 81 to clean the nozzle surfaces 51*a*.

Figure 2:
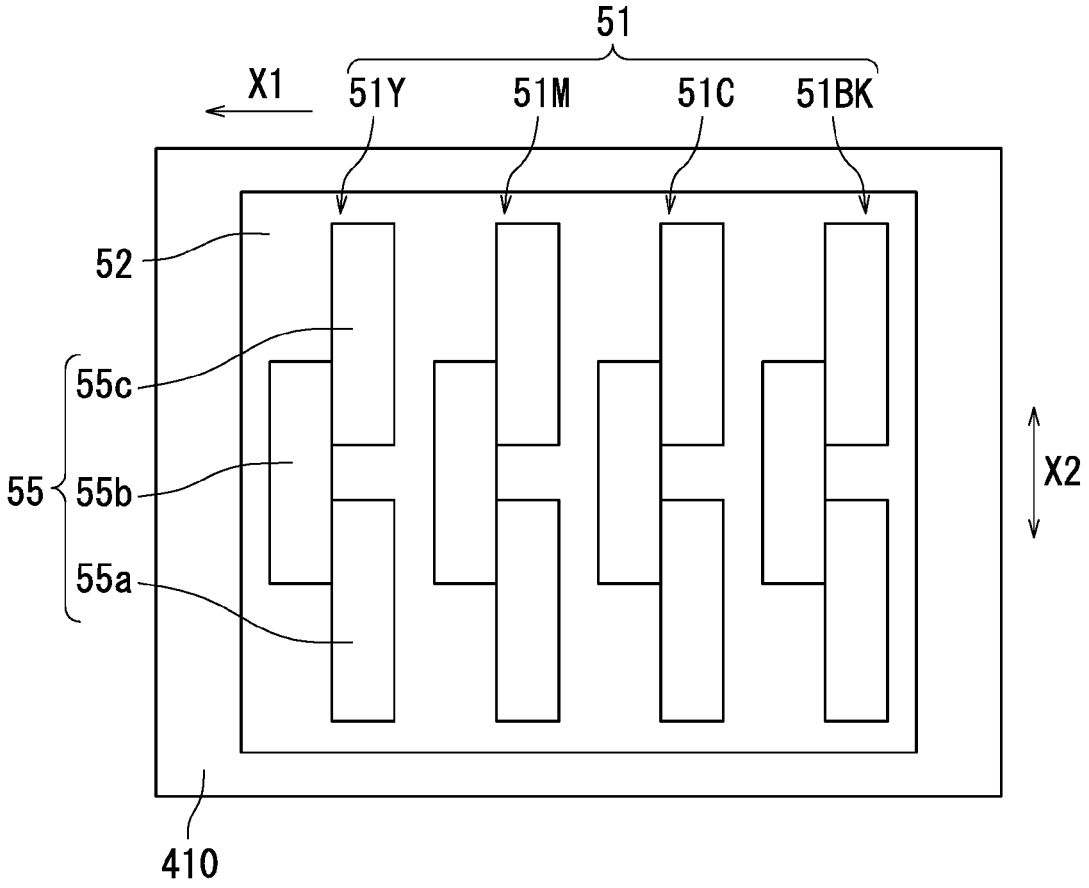
FIG. 2 is a plan view of a first conveyance section and a recording section illustrated in FIG. 1 as viewed from above.

Referring to FIG. 2, structure of the line heads 51 will be described next. FIG. 2 is a plan view of the first conveyance section 4 and the recording section 5 illustrated in FIG. 1 as viewed from above. As illustrated in FIG. 2, the line heads 51Bk, 51C, 51M, and 51Y are arranged side by side from upstream to downstream in the sheet conveyance direction X1 (leftward in FIG. 2).

The line heads 51Bk, 51C, 51M, and 51Y each include a first recording head 55*a*, a second recording head 55*b*, and a third recording head 55*c*. The first, second, and third recording heads 55*a*, 55*b*, and 55*c* are arranged in a staggered formation in a direction X2 perpendicular to the sheet conveyance direction X1. Hereinafter, the direction X2 perpendicular to the sheet conveyance direction X1 is referred to a width direction X2. The first, second, and third recording heads 55*a*, 55*b*, and 55*c* have the same structure and may be accordingly referred to as recording heads 55.

The recording heads 55 each have the nozzle surface 51*a* described with reference to FIG. 1. The recording heads 55 discharge ink droplets from nozzle orifices located in correspondence with to-be-printed points on the sheet P conveyed by the first conveyor belt 410. Thus, an image including a character or a figure is recorded on the sheet P.

Figure 3:
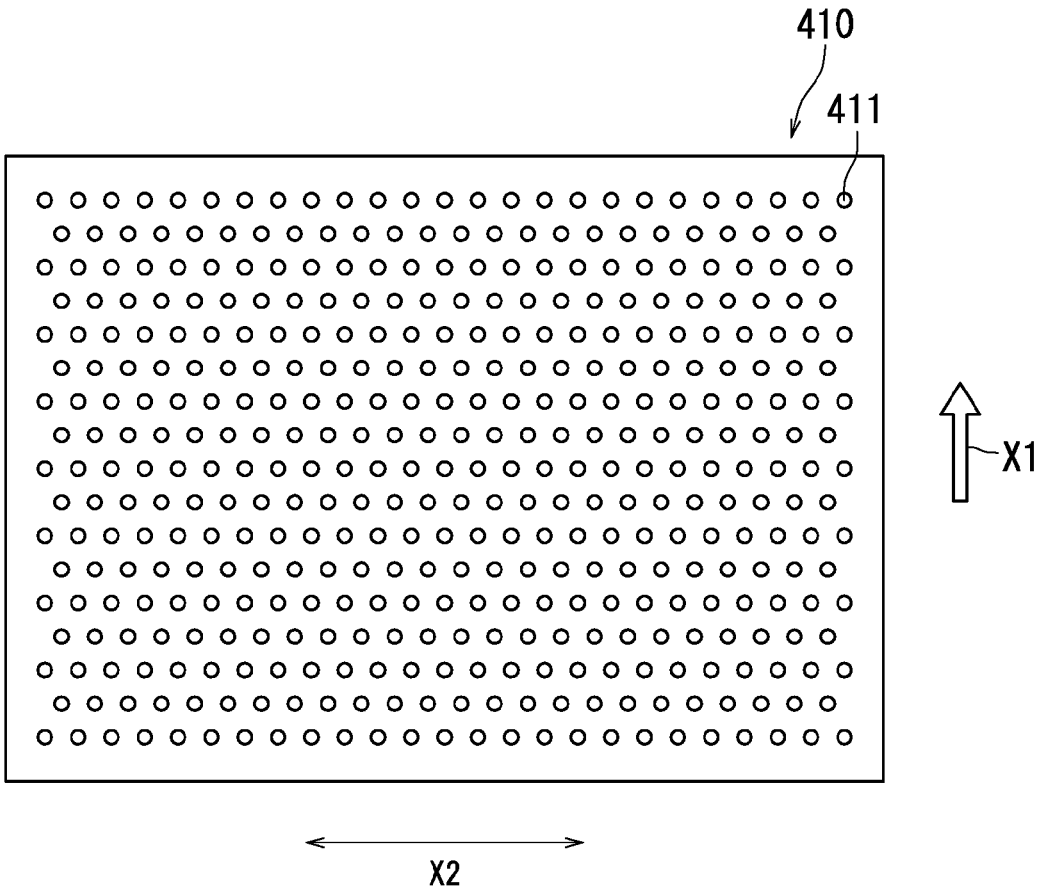
FIG. 3 is a plan view of a first conveyor belt illustrated in FIG. 1 as viewed from above.

With reference to FIG. 3, description will be made next about the first conveyor belt 410. FIG. 3 is a plan view of the first conveyor belt 410 illustrated in FIG. 1 as viewed from above. As illustrated in FIG. 3, a plurality of suction holes 411 are perforated in the first conveyor belt 410. Each of the suction holes 411 may have a diameter of 2 mm. Adjacent suction holes 411 may be spaced 8 mm from each other. The suction holes 411 are arranged in the sheet conveyance direction X1 and the width direction X2. The suction holes 411 may be arranged in a staggered formation as illustrated in FIG. 3.

Figure 4:
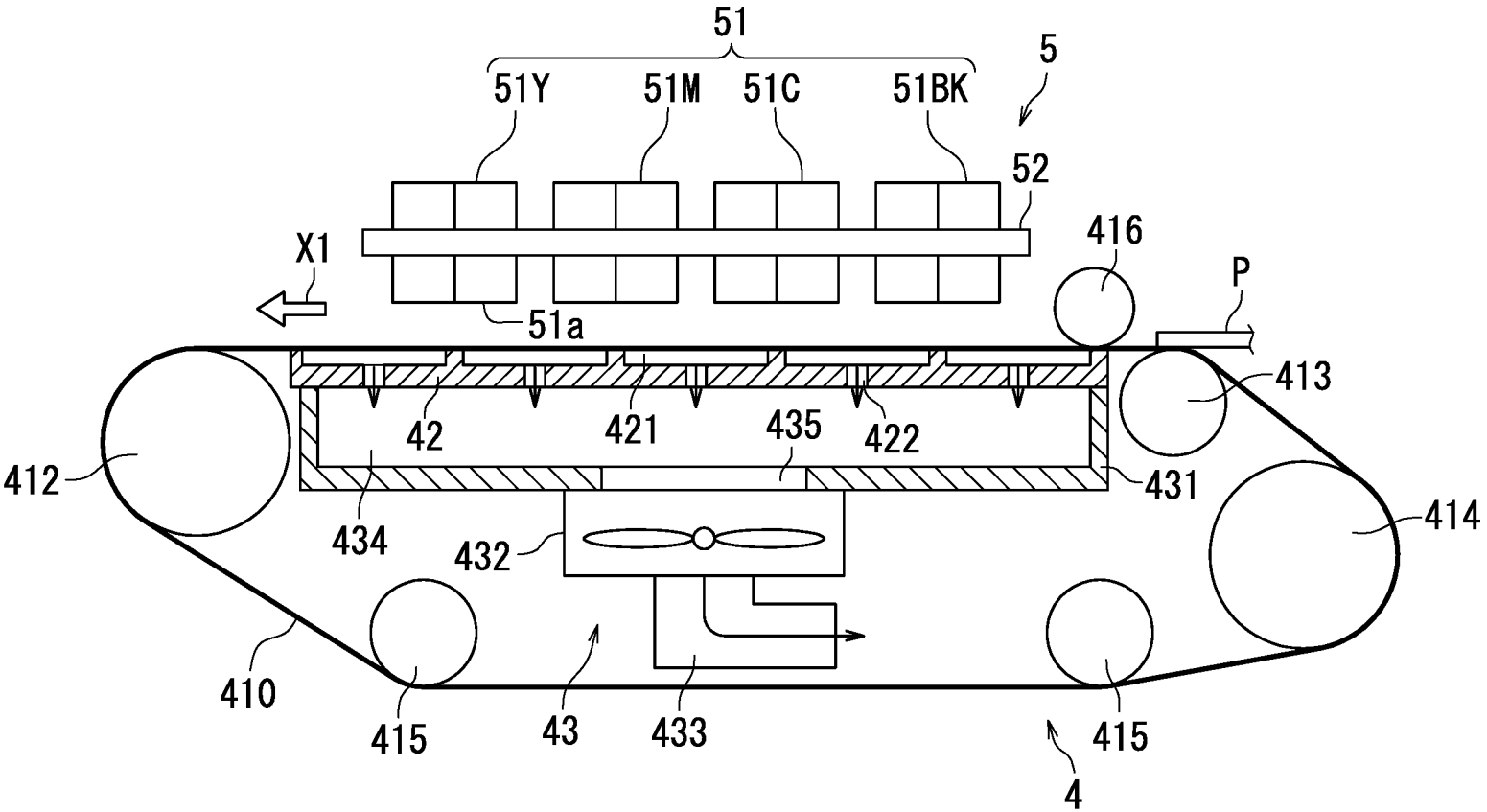
FIG. 4 illustrates structure of the first conveyance section and the recording section illustrated in FIG. 1.

With reference to FIGS. 1-4, a description will be made next about the first conveyance section 4 and the recording section 5. FIG. 4 illustrates structure of the first conveyance section 4 and the recording section 5 illustrated in FIG. 1. For the sake of easy understanding, FIG. 4 illustrates a section of a part of the first conveyance section 4.

The first conveyance section 4 is disposed opposite to the line heads 51 in the interior of the apparatus housing 100 (see FIG. 1). The first conveyance section 4 includes a drive roller 412, a belt speed detecting roller 413, a tension roller 414, and a pair of guide rollers 415. The drive roller 412, the belt speed detecting roller 413, the tension roller 414, and the pair of guide rollers 415 are disposed on the internal side of the first conveyor belt 410. The first conveyance section 4 further includes a placement roller 416 disposed on the external side of the first conveyor belt 410. The first conveyance section 4 further includes a suction section 43 and a conveyance plate 42 that is an example of a guide member.

The first conveyor belt 410 is wound around the drive roller 412, the belt speed detecting roller 413, the tension roller 414, and the pair of guide rollers 415. The conveyance plate 42 and the suction section 43 are disposed on the internal side of the wound first conveyor belt 410. The conveyance plate 42 is disposed opposite to the line heads 51 with the first conveyor belt 410 therebetween. The suction section 43 is disposed below the conveyance plate 42 on the internal side of the first conveyor belt 410.

The drive roller 412 is disposed downstream of the conveyance plate 42 in the sheet conveyance direction X1 (left side in FIG. 4). The drive roller 412 is driven to rotate by a motor (not illustrated). As a result, the first conveyor belt 410 is circulated in a predetermined rotation direction (anticlockwise direction in FIG. 4). Circulation of the first conveyor belt 410 conveys a sheet P in the sheet conveyance direction X1.

The belt speed detecting roller 413 is disposed upstream of the conveyance plate 42 in the sheet conveyance direction X1 (right side in FIG. 4). The belt speed detecting roller 413 rotates by friction generated between the belt speed detecting roller 413 and the first conveyor belt 410. Preferably, the belt speed detecting roller 413 is located in cooperating relation with the drive roller 412 so as to ensure the flatness of the first conveyor belt 410 at regions opposite to the line heads 51.

The belt speed detecting roller 413 includes a pulse plate (not illustrated) that integrally rotates with the belt speed detecting roller 413. The rotational speed of the first conveyor belt 410 is measured by measuring the rotational speed of the pulse plate.

The tension roller 414 applies tensile force to the first conveyor belt 410 to ensure that the first conveyor belt 410 does not sag. The pair of guide rollers 415 guides the first conveyor belt 410 so that the first conveyor belt 410 passes below the suction section 43.

The placement roller 416 is a driven roller. The placement roller 416 is located opposite to an upstream end of the conveyance plate 42 in the sheet conveyance direction X1 with the first conveyor belt 410 therebetween. The placement roller 416 guides the sheet P forwarded by the pair of registration rollers 34 (see FIG. 1) onto the first conveyor belt 410 to cause the sheet P to be sucked on the first conveyor belt 410.

The conveyance plate 42 supports the first conveyor belt 410 while supporting the sheet P with the first conveyor belt 410 therebetween. The conveyance plate 42 guides the sheet P in the sheet conveyance direction X1 while the first conveyance section 4 (first conveyor belt 410) conveys the sheet P. The conveyance plate 42 has a plurality of grooves 421 arranged in the sheet conveyance direction X1. The grooves 421 each extend in the sheet conveyance direction X1. The grooves 421 are each open toward a side of the recording section 5 (toward a side of the first conveyor belt 410). In the above configuration, the grooves 421 are in communication with the respective suction holes 411 (see FIG. 3) in the first conveyor belt 410.

The conveyance plate 42 has a plurality of through holes 422 arranged in the sheet conveyance direction X1. The through holes 422 are located in one-to-one correspondence with the grooves 421. A mouth of each of the through holes 422 on the side of the recording section 5 (side of the first conveyor belt 410) is open at an inner surface (bottom surface) of a corresponding one of the grooves 421. In the above configuration, the through holes 422 are in communication with the respective suction holes 411 in the first conveyor belt 410 through a corresponding one of the grooves 421. By contrast, a mouth of each of the through holes 422 on the side of the suction section 43 is open at the lower surface of the conveyance plate 42.

The suction section 43 sucks the sheet P onto the first conveyor belt 410 with the conveyance plate 42 and the first conveyor belt 410 therebetween. As a result, the sheet P is sucked onto the first conveyor belt 410. Specifically, the suction section 43 sucks air in the space above the first conveyor belt 410 through the grooves 421 and the through holes 422 in the conveyance plate 42 and the suction holes 411 in the first conveyor belt 410. Such suction creates wind toward the suction section 43 in the space above the conveyance plate 42. When the sheet P guided onto the first conveyor belt 410 covers a portion of the first conveyor belt 410, suction force (negative pressure) acts on the sheet P. As a result, the sheet P is sucked onto the first conveyor belt 410.

The suction section 43 includes a suction device 432, a duct 433, and a box member 431 having an open top. The conveyance plate 42 is disposed so as to cover the open top of the box member 431. The conveyance plate 42 and the box member 431 define a pressure chamber 434. The pressure chamber 434 is in communication with the suction holes 411 in the first conveyor belt 410 through the through holes 422 and the grooves 421 in the conveyance plate 42.

The suction device 432 is secured on the lower surface of the box member 431. Specifically, the box member 431 has a bottom wall having an opening 435. The suction device 432 is disposed in correspondence with the opening 435. The suction device 432 is connected to the duct 433. The suction device 432 is a fan. However, the suction device 432 is not limited to being a fan and may for example be a vacuum pump instead.

The suction device 432 is driven to generate negative pressure in the pressure chamber 434. The negative pressure generates suction force in the grooves 421 through the through holes 422 to generate suction force in the suction holes 411 in the first conveyor belt 410 through the grooves 421. As a result, air is sucked into the pressure chamber 434 through the suction holes 411 in the first conveyor belt 410 and the grooves 421 and the through holes 422 in the conveyance plate 42. The air sucked into the pressure chamber 434 is exhausted through the suction device 432 and the duct 433. When the sheet P guided onto the first conveyor belt 410 covers a portion of the suction holes 411, the suction force (negative pressure) acts on the sheet P through the suction holes 411 covered with the sheet P, thereby causing the sheet P to be sucked onto the first conveyor belt 410.

The line heads 51 are held on the head base 52. Accordingly, the line heads 51 may be supported at a height at which a predetermined distance (1 mm in the present embodiment) is spaced between the first conveyor belt 410 and the line heads 51. The inkjet recording apparatus 1 may include a raising and lowering mechanism that raises and lowers the head base 52 according to the thickness of a sheet P conveyed by the first conveyor belt 410. The raising and lowering mechanism enables the line heads 51 to be support at a height at which a predetermined distance (1 mm in the present embodiment) is spaced between a sheet P and the line heads 51.

Figure 5:
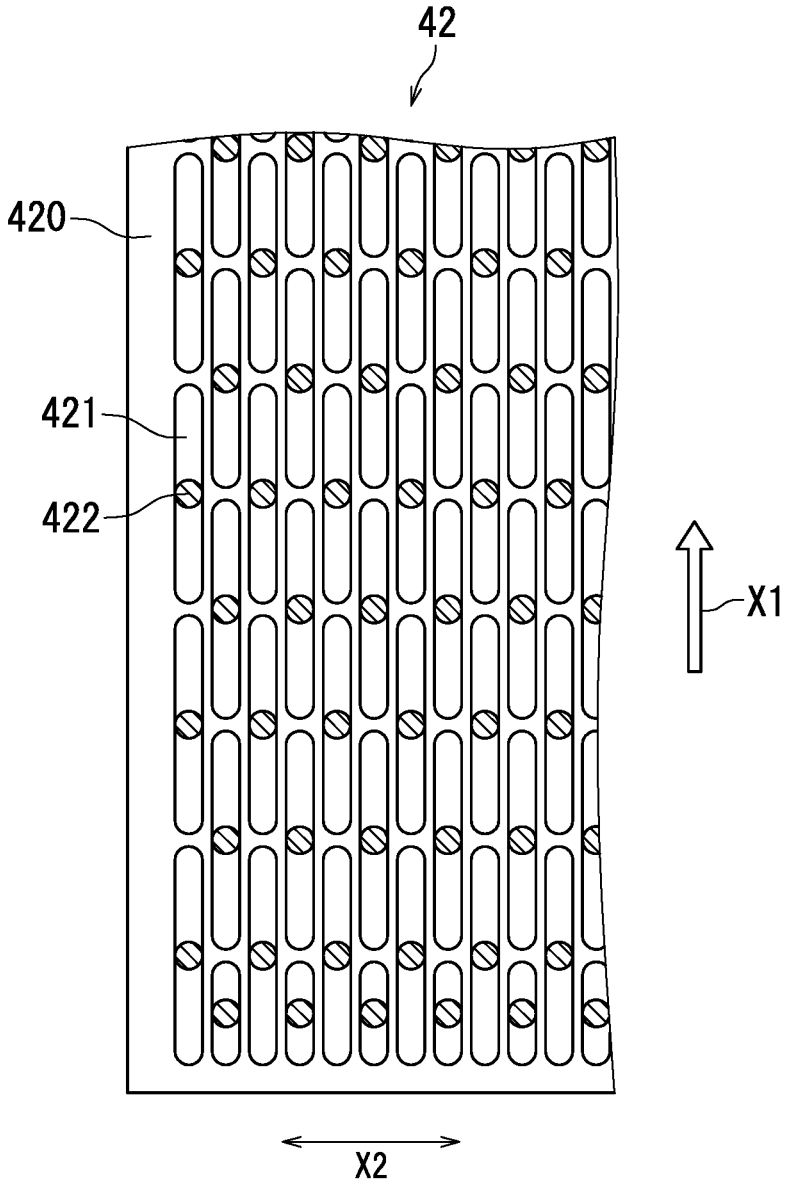
FIG. 5 is a plan view of a conveyance plate illustrated in FIG. 4 as viewed from above.
Figure 6A:
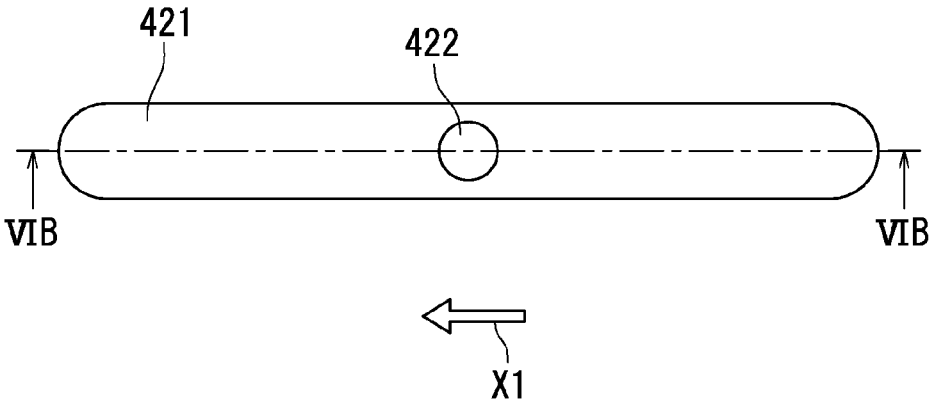
FIG. 6A is a plan view illustrating a groove and a through hole in the conveyance plate according to the first embodiment.
Figure 6B:
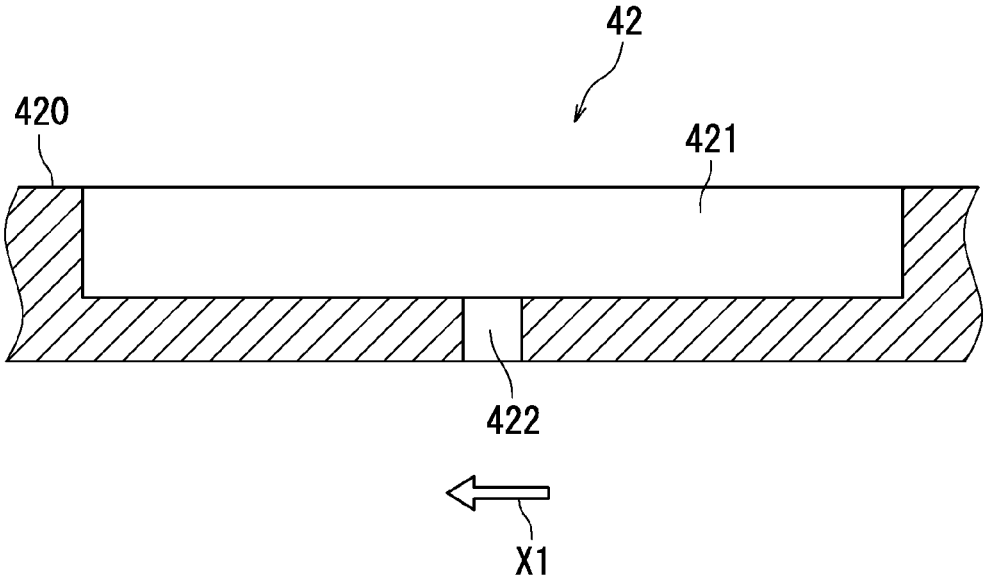
FIG. 6B is a cross sectional view of the groove and the through hole taken along the line VIB-VIB in FIG. 6A.

With reference to FIGS. 5, 6A, and 6B, a description will be made about the conveyance plate 42. FIG. 5 is a plan view of the conveyance plate 42 illustrated in FIG. 4 as viewed from above. Specifically, FIG. 5 illustrates a part of a surface 420 of the conveyance plate 42 on the side of the line heads 51. Hereinafter, the surface 420 of the conveyance plate 42 on the side of the line heads 51 is referred to as a support surface 420. The conveyance plate 42 supports the sheet P on the support surface 420 with the first conveyor belt 410 therebetween.

The conveyance plate 42 is made from a metal material. Specifically, for example, the conveyance plate 42 may be made from die-cast aluminum or a pressed metal plate. Alternatively, the conveyance plate 42 may be made from resin having excellent slidability against the first conveyor belt 410. In a situation in which the conveyance plate 42 is made from a metal material, the conveyance plate 42 may be earthed.

As illustrated in FIG. 5, the support surface 420 has the plurality of grooves 421. The grooves 421 are elongated grooves open toward the line heads 51. Specifically, each of the grooves 421 is shaped in an elongated circular shape extending in the sheet conveyance direction X1.

The grooves 421 are arranged in the sheet conveyance direction X1 and the width direction X2. The grooves 421 may be arranged in a staggered formation, as illustrated in FIG. 5. Specifically, the grooves 421 are arranged so as to be able to be opposite to the respective suction holes 411 in the first conveyor belt 410 (see FIG. 3). In other words, the grooves 421 are in communication with the respective suction holes 411. In the above arrangement, the suction holes 411 that are opposite to the grooves 421 change one-by-one as the first conveyor belt 410 advances (circulates). The grooves 421 each are located so as to be able to be opposite to at least two suction hoes 411.

The grooves 421 each has one through hole 422. The through holes 422 each are in communication with a corresponding one of the grooves 421. The through holes 422 each have a circular shape in section. The through holes 422 may be arranged in a staggered formation, as illustrated in FIG. 5.

FIG. 6A is a plan view of a groove 421 and a through hole 422 in the conveyance plate 42. FIG. 6B is a cross sectional view (vertical cross sectional view) of the groove 421 and the through hole 422 taken along the line VIB-VIB in FIG. 6A. As illustrated in FIGS. 6A and 6B, the through hole 422 passes through the conveyance plate 42 in the thickness direction thereof and one end of the through hole 422 is open in the groove 421.

Figure 7:
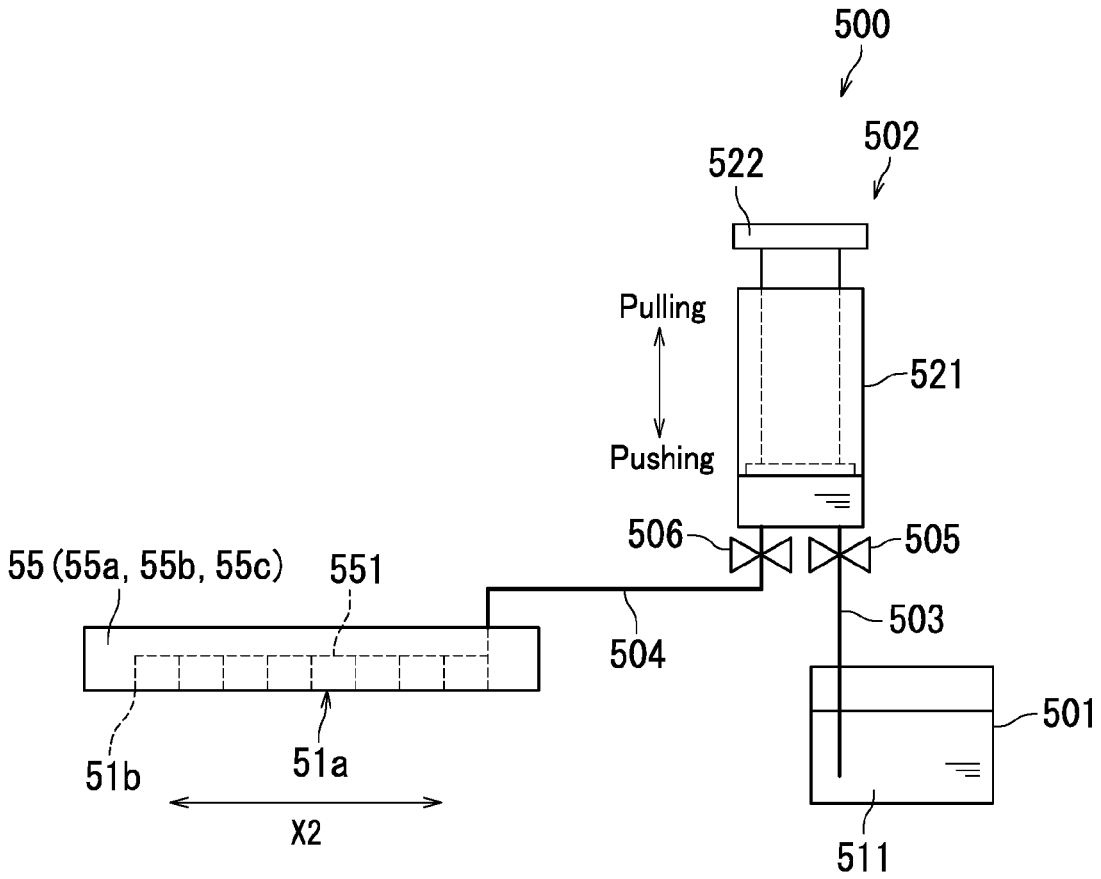
FIG. 7 illustrates structure of an ink supplying mechanism according to the first embodiment.

With reference to FIG. 7, a description will be made next about an ink supplying mechanism 500 that supplies ink to the recording heads 55 of a corresponding one of the line heads 51. FIG. 7 illustrates structure of the ink supplying mechanism 500 according to the first embodiment. Specifically, FIG. 7 illustrates the ink supplying mechanism 500 for supplying an ink of any one of the colors. The inkjet recording apparatus 1 illustrated in FIG. 1 includes the ink supplying mechanism 500 illustrated in FIG. 7 for each color of black, cyan, magenta, and yellow.

As illustrated in FIG. 7, the ink supplying mechanism 500 includes an ink tank 501 and a pump mechanism 502. The ink supplying mechanism 500 further includes a first flow channel 503 and a second flow channel 504. The first flow channel 503 connects the ink tank 501 to the pump mechanism 502. The second flow channel 504 connects the pump mechanism 502 to the recording heads 55. The ink supplying mechanism 500 further includes a first solenoid valve 505 and a second solenoid valve 506. The first solenoid valve 505 that is an example of an inflow side switching valve is disposed in the first flow channel 503. The second solenoid valve 506 that is an example of an outflow side switching valve is disposed in the second flow channel 504.

The second flow channel 504 connects the pump mechanism 502 to each of the first, second, and third recording heads 55*a*, 55*b*, and 55*c*, which are described with reference to FIG. 2. However, only any one of the first, second, and third recording heads 55*a*, 55*b*, and 55*c* is illustrated in FIG. 7 for the sake of easy understanding.

The ink tank 501 contains an ink 511 of any one of the colors. The pump mechanism 502 includes a hollow cylinder 521 and a piston 522. The cylinder 521 receives in the hollow space thereof a part of the piston 522. The piston 522 is movable in the longitudinal direction of the cylinder 521 by a driving device (not illustrated).

The first flow channel 503 has one end connected to the ink tank 501 and the other end connected to an ink inlet formed in the bottom of the cylinder 521. The second flow channel 504 has one end connected to an ink outlet formed in the bottom of the cylinder 521 and the other end connected to an inlet of a micro flow channel 551. The micro flow channel 551 is located inside the recording head 55.

The recording head 55 has the nozzle surface 51*a* having the nozzle orifices 51*b* arranged in the width direction X2. The nozzle orifices 51*b* are each in communication with the micro flow channel 551.

In image recording on a sheet P, the ink 511 is contained in the cylinder 521. The first and second solenoid valves 505 and 506 are both opened, and the piston 522 stays at a predetermined position. When ink droplets are discharged from the recording head 55 (nozzle orifices 51*b*), the ink 511 is supplied from the cylinder 521 to the micro flow channel 551 of the recording head 55 due to capillarity. In introducing the ink 511 into the cylinder 521, the piston 522 of the pump mechanism 502 performs pulling in a state in which the first solenoid valve 505 is opened and the second solenoid valve 506 is closed. This draws the ink 511 in the ink tank 501 into the cylinder 521 of the pump mechanism 502 through the first flow channel 503.

The ink supplying mechanism 500 operates in maintenance of the line heads 51 (recording heads 55), specifically, in purging. The ink supplying mechanism 500 is controlled by the control section 9 illustrated in FIG. 1. In purging, the ink 511 is contained in the cylinder 521. The first solenoid valve 505 is closed and the second solenoid valve 506 is opened. The piston performs pushing. As a result, the ink 511 in the cylinder 521 is supplied to the micro flow channel 551 through the second flow channel 504. The ink 511 present in the micro flow channel 551 is forcedly extruded out (purged) from the nozzle orifices 51*b*. By the above purging, air babbles, thickened ink 511, foreign matter such as paper dust are extruded outside the recording head 55. Air babbles, thickened ink 511, foreign matter such as paper dust are factors of causing discharge disablement.

Figure 8:
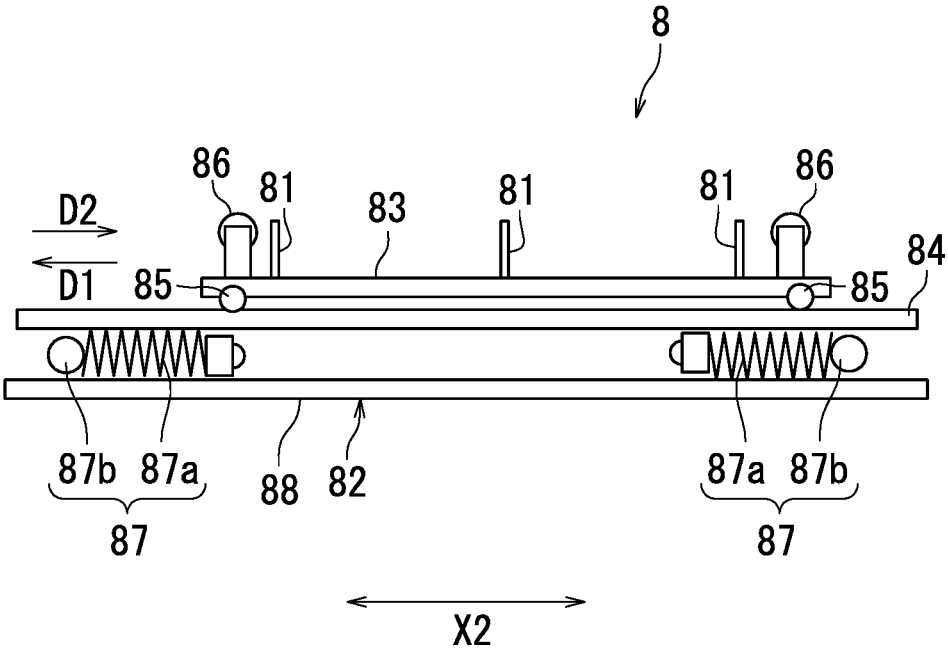
FIG. 8 illustrates a first state of a wiping unit illustrated in FIG. 1.
Figure 9:
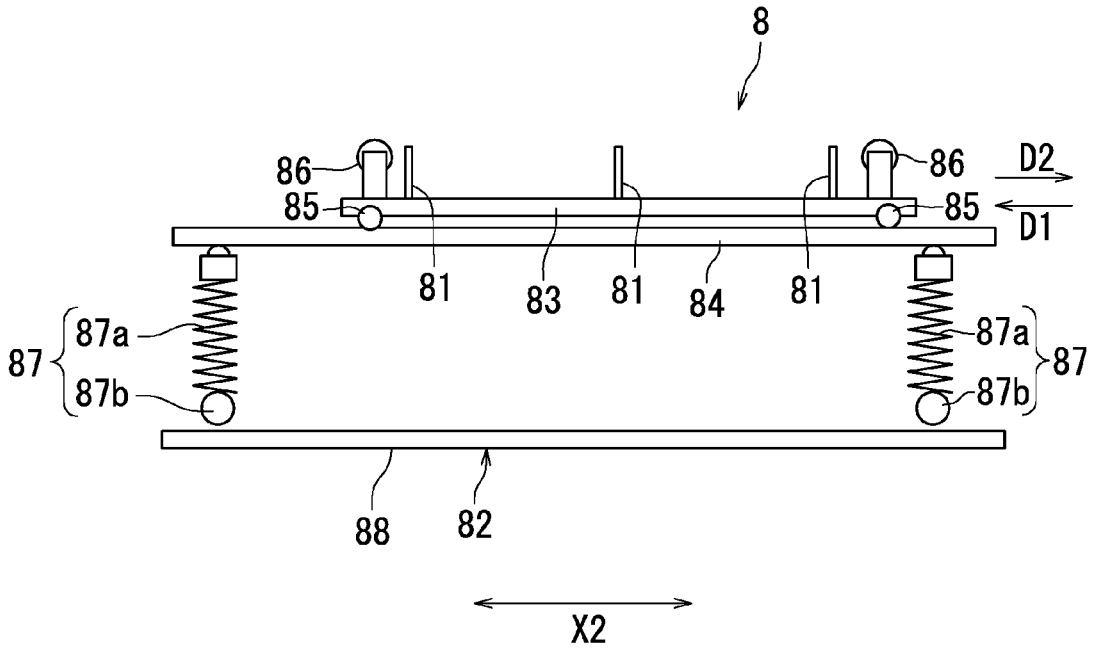
FIG. 9 illustrates a second state of the wiping unit illustrated in FIG. 1.

The wiping unit 8 will be described next with reference to FIGS. 8 and 9. FIG. 8 illustrates a first state of the wiping unit 8 illustrate in FIG. 1. FIG. 9 illustrates a second state of the wiping unit 8 illustrated in FIG. 1. The wiping unit 8 is in the second state in maintenance on the line heads 51 (recording heads 55). The wiping unit 8 is controlled by the control section 9 illustrated in FIG. 1.

FIGS. 8 and 9 each illustrate three wiper blades 81 for any one of the line heads 51Bk, 51C, 51M, and 51Y for the four colors for the sake of easy understanding. The wiping unit 8 includes three wiper blades 81 for each of the line heads 51Bk, 51C, 51M, and 51Y. The three wiper blades 81 are disposed in correspondence with the first, second, and third recording heads 55*a*, 55*b*, and 55*c*, which are described with reference to FIG. 2.

As illustrated in FIG. 8, the wiping unit 8 includes a movement mechanism 82 in addition to the wiper blades 81. The movement mechanism 82 moves the wiper blades 81 in a direction indicated by an arrow D1 (leftward in FIG. 8) and a direction indicated by an arrow D2 (rightward in FIG. 8). Hereinafter, the direction indicated by the arrow D1 is referred to as a main scanning direction D1 and the direction indicated by the arrow D2 is referred to as a return direction D2. The main scanning direction D1 is a direction toward one end from the other end of each of the recording heads 55 in the width direction X2. The return direction D2 is a direction opposite to the main scanning direction D1.

The movement mechanism 82 includes a carriage 83 and a supporting frame 84 that supports the carriage 83. The movement mechanism 82 further includes rolls 85, gap rolls 86, raising and lowering members 87, and a bottom portion 88.

The raising and lowering members 87 are each constituted by a lifting member 87*a* and a shaft 87*b*. When the wiping unit 8 is in the first state, the lifting member 87*a* of each of the raising and lowering members 87 lies down on the bottom portion 88.

In transition of the wiping unit 8 from the first state to the second state, the shaft 87*b* of each of the raising and lowering member 87 rotates. Specifically, the shaft 87*b* of the raising and lowering member 87 of the raising and lowering members 87 disposed upstream in the main scanning direction D1 (right side in FIG. 8) rotates in the clockwise direction in FIG. 8. On the other hand, the shaft 87*b* of the other raising and lowering member 87 disposed downstream in the main scanning direction D1 (left side in FIG. 8) rotates in the anticlockwise direction in FIG. 8. As a result, the lying lifting members 87*a* stand up from the bottom portion 88, as illustrated in FIG. 9. The lifting members 87*a* stand up to raise the carriage 83, the rolls 85, the gap rolls 86, and the wiper blades 81 together with the supporting frame 84, thereby setting the wiping unit 8 into the second state. The wiping unit 8 becomes in the second state before performing purging.

The wiping unit 8 transitions from the second state to the first state after the wiper blades 81 clean the nozzle surfaces 51*a* illustrated in FIG. 1. In transition of the wiping unit 8 from the second state to the first state, the shafts 87*b* of the raising and lowering members 87 rotate in directions opposite to the directions in which the shafts 87*b* of the raising and lowering members 87 rotate in transition of the wiping unit 8 from the first state to the second state. Specifically, the shaft 87*b* of the raising and lowering member 87 of the raising and lowering members 87 disposed upstream in the main scanning direction D1 (right side in FIG. 9) rotates in the anticlockwise direction in FIG. 9. On the other hand, the shaft 87*b* of the other raising and lowering member 87 disposed downstream in the main scanning direction D1 (left side in FIG. 9) rotates in the clockwise direction in FIG. 9. As a result, the standing lifting members 87*a* lie down on the bottom portion 88, as illustrated in FIG. 8. The lifting members 87*a* lie down to lower the carriage 83, the rolls 85, the gap rolls 86, and the wiper blades 81 together with the supporting frame 84, thereby setting the wiping unit 8 into the first state.

The carriage 83 movably engages with the supporting frame 84 through the rolls 85. Specifically, the carriage 83 engages with the supporting frame 84 in a movable manner in the main scanning direction D1 and the return direction D2. The wiper blades 81 are mounted on the carriage 83. Movement of the carriage 83 in the main scanning direction D1 or the return direction D2 moves the wiper blades 81 in the main scanning direction D1 or the return direction D2.

The carriage 83 moves in the main scanning direction D1 in wiping. Movement of the carriage 83 in the main scanning direction D1 moves the wiper blades 81 in the main scanning direction D1. Through the movement of the wiper blades 81, the nozzle surfaces 51*a* are wiped by the wiper blades 81. Wiping by the wiper blades 81 cleans the nozzle surfaces 51*a*. When cleaning on the nozzle surfaces 51*a* ends and the wiping unit 8 transitions from the second state to the first state, the carriage 83 moves in the return direction D2. This movement of the carriage 83 causes the wiper blades 81 to return to the original positions.

The respective groups of the three wiper blades 81 of the corresponding line heads 51Bk, 51C, 51M, and 51Y for the four colors perform the same operation according to rotation of the shafts 87*b* and movement of the carriage 83.

With reference to FIGS. 10-14C, a description will be made next about operation of the inkjet recording apparatus 1 for maintenance on the line heads 51 (recording heads 55). In the inkjet recording apparatus 1 in the present embodiment, the maintenance mechanism for the line heads 51 includes the ink supplying mechanisms 500 described with reference to FIG. 7 and the wiping unit 8 described with reference to FIGS. 8 and 9.

As described with reference to FIG. 1, the maintenance on the line heads 51 in the present embodiment means both the regular maintenance and the sheet width dependent maintenance. The operation of the inkjet recording apparatus 1 in the sheet width dependent maintenance is the same as the operation of the inkjet recording apparatus 1 in the regular maintenance. The sheet width dependent maintenance is different from the regular maintenance in a condition for initiation.

Figure 10:
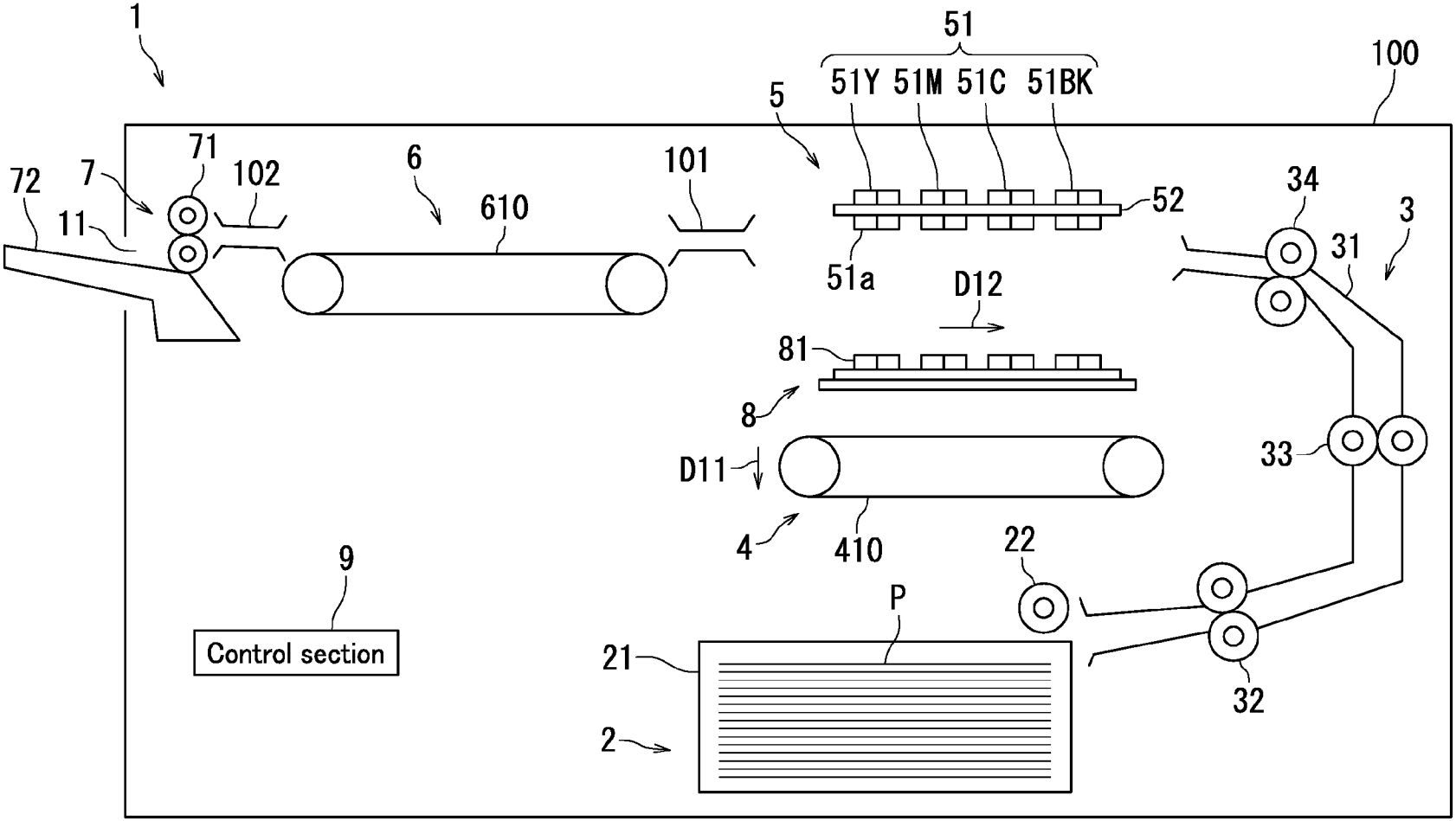
FIG. 10 illustrates operation of the inkjet recording apparatus according to the first embodiment.
Figure 11:
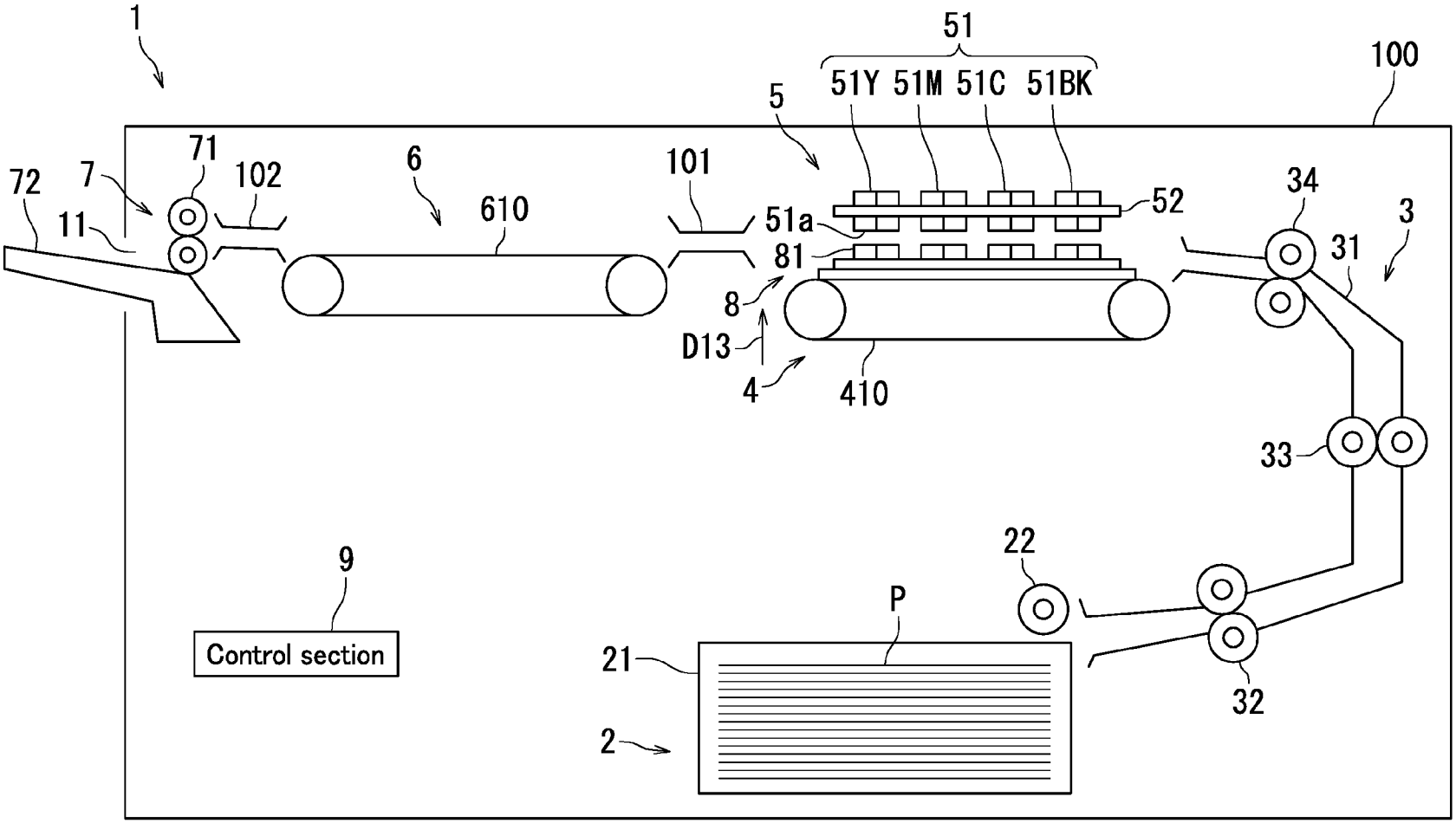
FIG. 11 illustrates the operation of the inkjet recording apparatus according to the first embodiment.

FIGS. 10 and 11 each illustrate the operation of the inkjet recording apparatus 1. Specifically, FIGS. 10 and 11 each illustrate the operation of the inkjet recording apparatus 1 in maintenance on the line heads 51. In maintenance on the line heads 51 (recording heads 55), as illustrated in FIG. 10, the first conveyance section 4 first moves away from the line heads 51 in a direction indicated by an arrow D11 (downward direction). The wiping unit 8 then moves in a direction indicated by an arrow D12 (rightward in FIG. 10) and stops at a location between the recording section 5 (line heads 51) and the first conveyance section 4.

Subsequently, as illustrated in FIG. 11, the first conveyance section 4 moves in a direction indicated by an arrow D13 (upward) to raise the wiping unit 8. As a result, the wiping unit 8 is moved directly below the recording section 5 (line heads 51).

Figure 12:
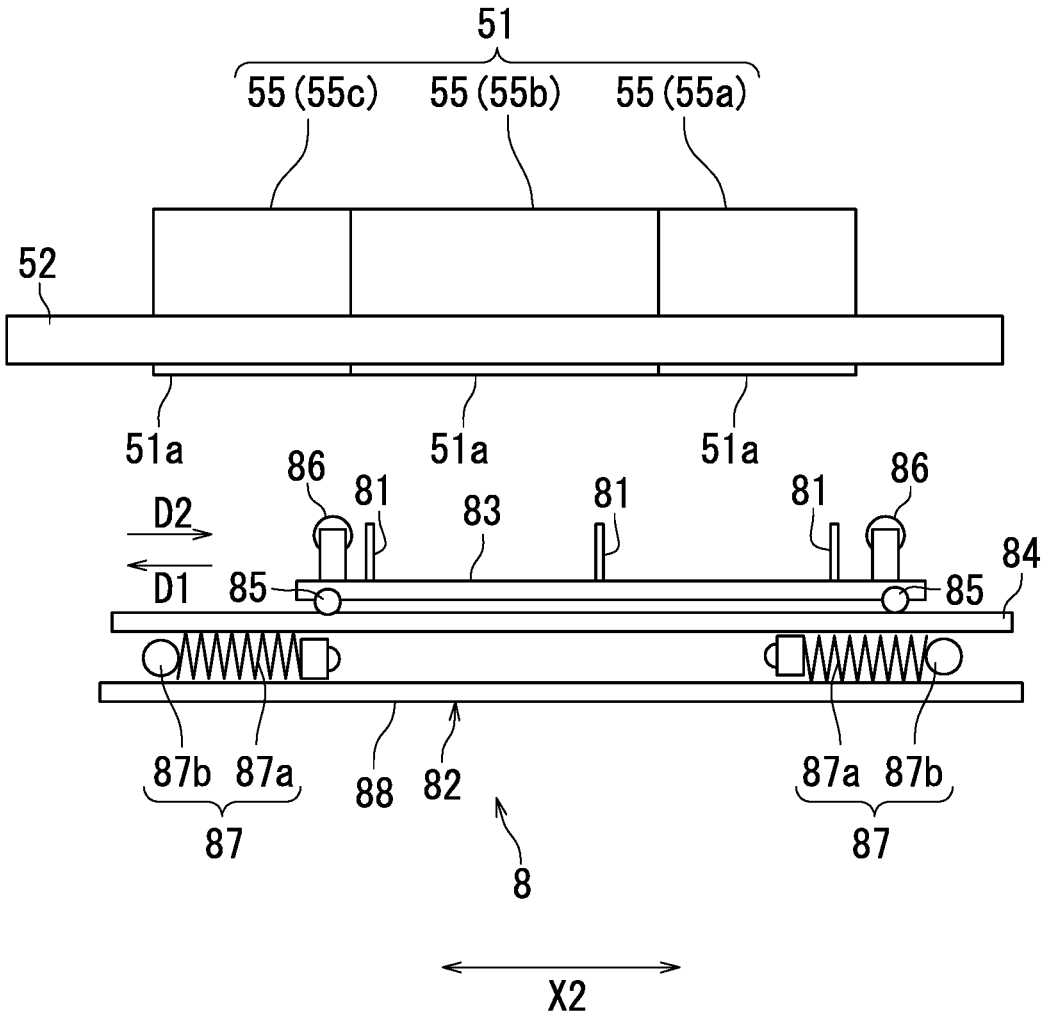
FIG. 12 illustrates operation of the wiping unit according to the first embodiment.
Figure 13:
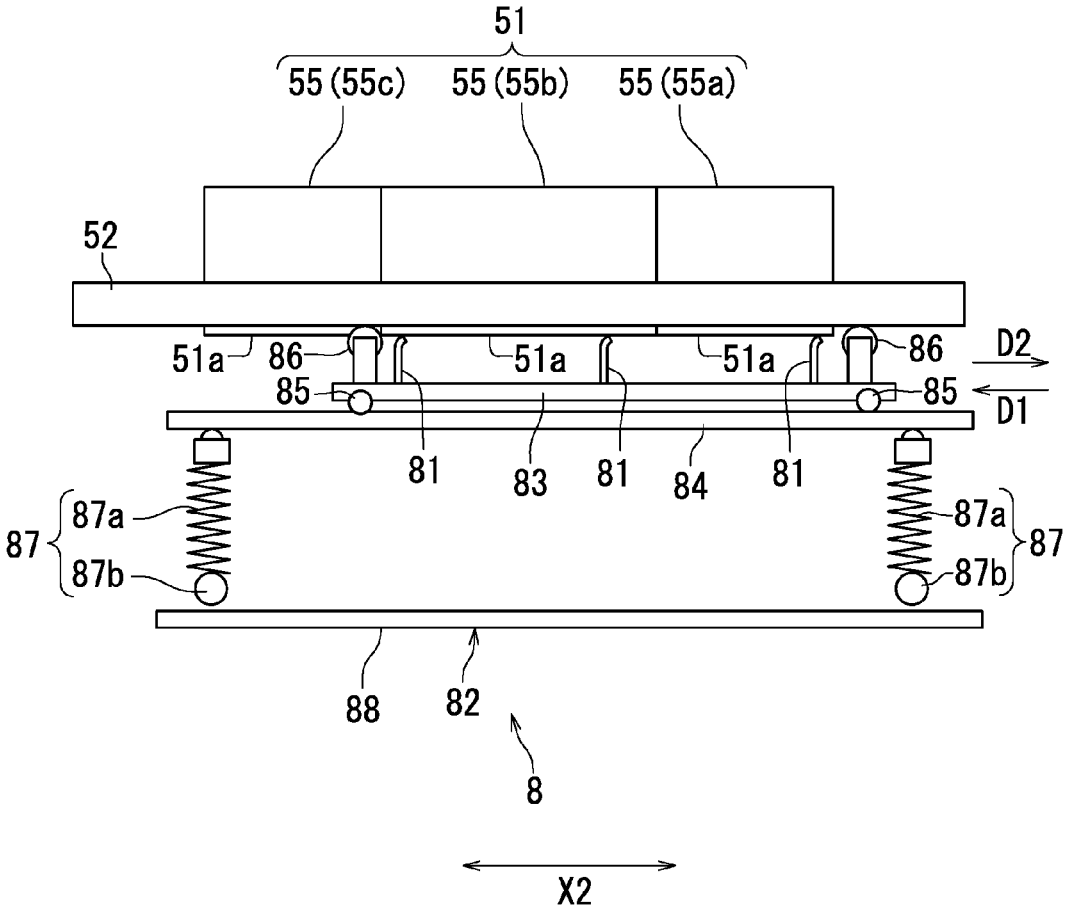
FIG. 13 illustrates the operation of the wiping unit according to the first embodiment.

FIGS. 12 and 13 each illustrate operation of the wiping unit 8. Specifically, FIGS. 12 and 13 each illustrate the operation of the wiping unit 8 in maintenance on the line heads 51. As illustrated in FIG. 12, the wiping unit 8 is in the first state described with reference to FIG. 8 in moving directly below the line heads 51. Note that FIGS. 12 and 13 illustrate, likewise FIGS. 8 and 9, three wiper blades 81 for any one of the line heads 51Bk, 51C, 51M, and 51Y for the four colors for the sake of easy understanding.

When the wiping unit 8 moves directly below the line heads 51, the wiping unit 8 transitions from the first state to the second state as described with reference to FIGS. 8 and 9. FIG. 13 illustrates the wiping unit 8 having transitioned from the first state to the second state directly below the line heads 51. When the wiping unit 8 transitions from the first state to the second state directly below the line heads 51, the wiper blades 81 are each pushed against the nozzle surface 51*a* of a corresponding one of the recording heads 55. Specifically, the wiper blades 81 are each pushed against one end of corresponding one of the nozzle surfaces 51*a* in the main scanning direction D1 (right end in FIG. 13). The gap rolls 86 come in contact with the head base 52. Contact of the gap rolls 86 with the head base 52 causes the wiper blades 81 pushed against the nozzle surfaces 51*a* to be held constant at a given location in the vertical direction.

When the wiping unit 8 transitions from the first state to the second state, the ink supplying mechanisms 500 perform purging as described with reference to FIG. 7. Through the purging, ink is extruded from the line heads 51 (recording heads 55) and falls onto the supporting frame 84. The supporting frame 84 has an upper surface that forms an ink collection tray (not illustrated). The falling purged ink is collected into the ink collection tray. Part of the purged ink remains on the nozzle surfaces 51*a*.

After purging, the wiping unit 8 performs wiping as described with reference to FIG. 9. That is, the carriage 83 moves in the main scanning direction D1 to move the wiper blades 81 in the main scanning direction D1. The movement of the wiper blades 81 causes the wiper blades 81 to wipe the nozzle surfaces 51*a*. As a result, the purged ink remaining on the nozzle surfaces 51*a* flows down along the wiper blades 81 from the nozzle surfaces 51*a* to be collected onto the supporting frame 84 (into the ink collection tray).

Figure 14A:
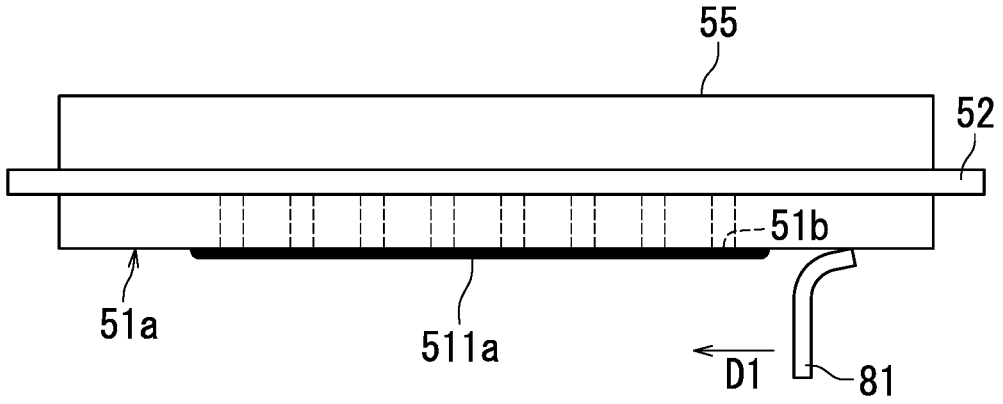
FIGS. 14A-14C each illustrate operation of a wiper blade according to the first embodiment.
Figure 14B:
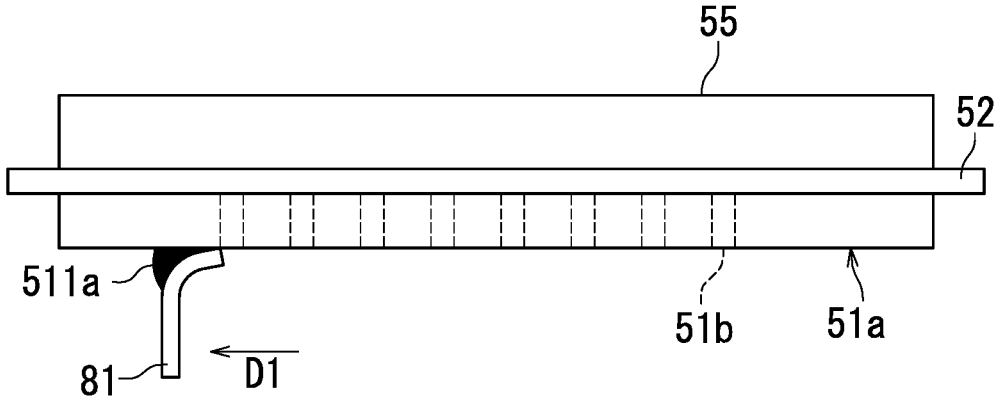
Figure 14C:
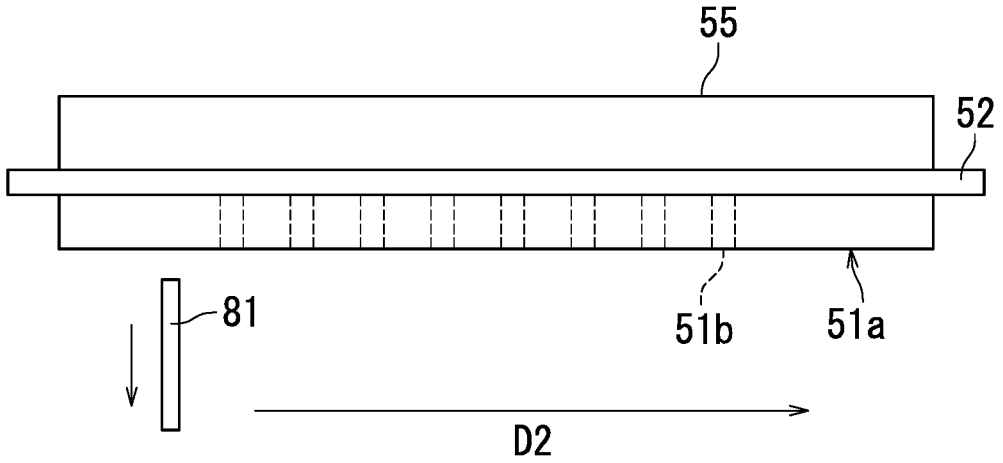

FIGS. 14A-14C each illustrate operation of a wiper blade 81. Specifically, FIGS. 14A-14C each illustrate the operation of the wiper blade 81 in maintenance (wiping) on a recording head 55. As illustrated in FIG. 14A, when the ink supplying mechanism 500 described with reference to FIG. 7 performs purging, part of purged ink 511*a* extruded through the nozzle orifices 51*b* of the recording head 55 remains on a nozzle surface 51*a*. In wiping, as illustrated in FIGS. 14A and 14B, the wiper blade 81 moves in the main scanning direction D1 while being pushed against the nozzle surface 51*a*. Movement of the wiper blade 81 causes the wiper blade 81 to wipe the purged ink 511*a* remaining on the nozzle surface 51*a*. As a result, the purged ink 511*a* falls down along the wiper blade 81 from the nozzle surface 51*a*.

When wiping ends, the wiping unit 8 transitions from the second state to the first state, as described with reference to FIGS. 8 and 9. As a result, as illustrated in FIG. 14C, the wiper blade 81 is lowered from the nozzle surface 51*a* to be separate from the nozzle surface 51*a*. Then, the carriage 83 described with reference to FIGS. 8 and 9 moves in the return direction D2. The wiper blade 81 accordingly moves in the return direction D2 to be located at the original position illustrated in FIG. 8.

Figure 15:
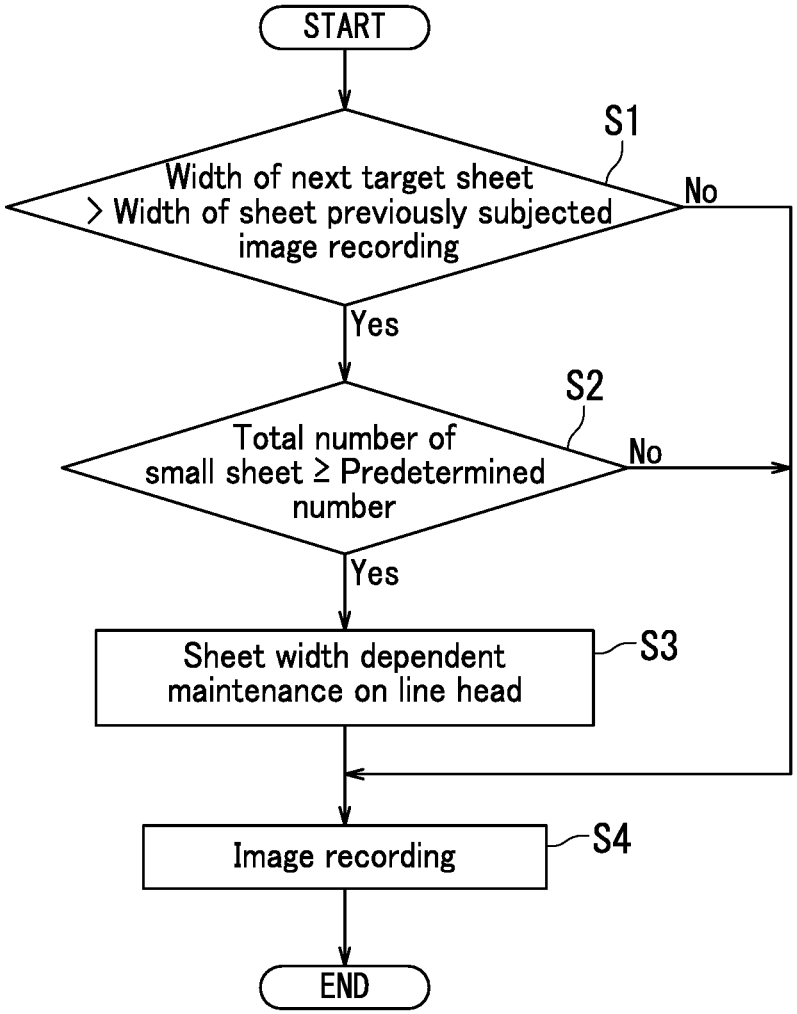
FIG. 15 is a flowchart depicting a process flow of a control section included in the inkjet recording apparatus according to the first embodiment.

With reference to FIG. 15, a description will be made next about a maintenance method for the line heads 51 (recording heads 55) in the present embodiment. Specifically, a description will be made about execution timing of the sheet width dependent maintenance. FIG. 15 is a flowchart depicting a process flow of the control section 9 (see FIG. 1) included in the inkjet recording apparatus 1 according to the present embodiment. Specifically, FIG. 15 depicts a process flow for determining whether or not to perform the sheet width dependent maintenance.

The control section 9 executes processing of Steps S1-S4 indicated in FIG. 15 in execution of a new print job.

In execution of a new print job, the control section 9 first determines whether or not the width of a next recording target sheet P is greater than the width of a sheet P subjected to image recording (Step S1) prior to the next recording target sheet P.

Upon determining that the width of the next recording target sheet P is greater than the width of the sheet P previously subjected to image recording (Yes at Step S1), the control section 9 determines whether or not the total number of small sheets P is no less than a predetermined number (Step S2). That is, the control section 9 determines whether or not image recording has been performed on the predetermined number or more of sheets P having a width smaller than the width of the next recording target sheet P.

Upon determining that the total number of small sheets P is no less than the predetermined number (Yes at Step S2), the control section 9 causes the maintenance mechanism to operate. The sheet width dependent maintenance is accordingly performed on the line heads 51 (recording heads 55) (Step S3).

When the sheet width dependent maintenance ends, the control section 9 controls the inkjet recording apparatus 1 to perform image recording on the next recording target sheet P (Step S4).

By contrast, upon determination at Step S1 that the width of the next recording target sheet P is no greater than the width of the sheet P previously subjected to image recording (No at Step S1), processing by the control section 9 proceeds to Step S4. Upon determination at Step S2 that the total number of small sheets P is less than the predetermined number (No at Step S2), processing by the control section 9 proceeds to Step S4.

Note that in a situation in which the predetermined number referenced in the processing at Step S2 is 1, the processing at Step S2 may be omitted.

As described above, in the present embodiment, the control section 9 controls the operation timing of the maintenance mechanism (the wiping unit 8 and the ink supplying mechanisms 500). Specifically, upon determining that the width of the next recording target sheet P is greater than the width of the sheet P previously subjected to image recording, the control section 9 causes the maintenance mechanism to operate. In the above configuration, even in a situation in which the width of the next recording target sheet P is greater than the width of a sheet P previously subjected to image recording, an image formed on the next recording target sheet P is unlikely to include a white line. In consequence, reduction in image quality can be prevented in the present embodiment.

Further, in the present embodiment, the sheet width dependent maintenance can be performed using the maintenance mechanism that performs the regular maintenance. In consequence, reduction in image quality can be reduced by a simple configuration.

Furthermore, in the present embodiment, the control section 9 causes the maintenance mechanism to operate upon determining that image recording has been performed on the predetermined number or more of sheets P having a width smaller than the width of the next recording target sheet P. In the above configuration, when the predetermined number is set to be small, an interval of execution of the sheet width dependent maintenance can be shortened to enhance image quality. Alternatively, when the predetermined number is set to be great, the amount of ink consumed in purging can be reduced.

Image recording on a sheet P cannot be performed during execution of maintenance on the line heads 51. For this reason, the shorter the interval of execution of the sheet width dependent maintenance, that is, the higher the frequency of execution of the sheet width dependent maintenance, the lower the processing speed (operation efficiency). To tackle this problem, in the present embodiment, the interval of execution of the sheet width dependent maintenance is increased by setting the predetermined number to be great for preventing lowering of the processing speed (operation efficiency).

Second Embodiment

A second embodiment will be described next with reference to the accompanying drawings. Note that a description about only matter different from that in the first embodiment is given and a description of the same matter as that in the first embodiment is omitted. The inkjet recording apparatus 1 according to the second embodiment is different from that according to the first embodiment in purging and wiping in the sheet width dependent maintenance. Specifically, in the second embodiment, the sheet width dependent maintenance is performed on respective parts of the line heads 51.

Figure 16:
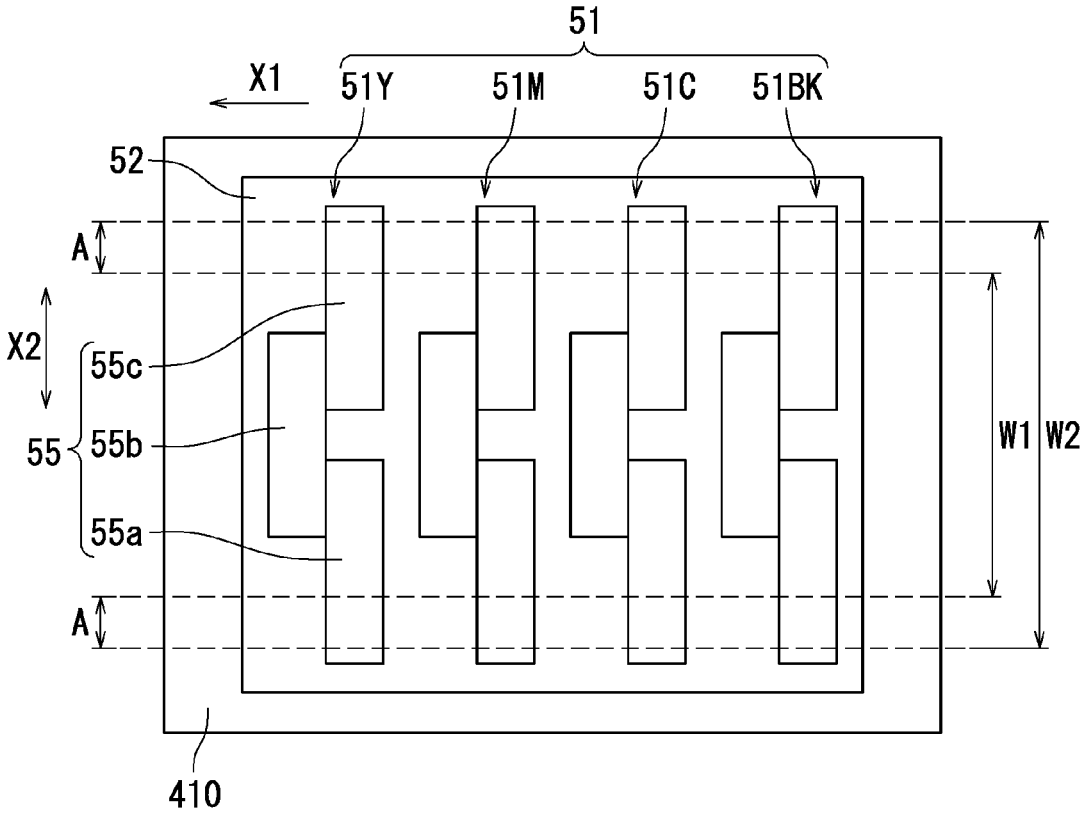
FIG. 16 illustrates a region on which maintenance is performed in a second embodiment.

FIG. 16 illustrates regions on which the maintenance is performed in the second embodiment. Specifically, FIG. 16 illustrates regions on which the sheet width dependent maintenance is performed. As illustrated in FIG. 16, the inkjet recording apparatus 1 according to the present embodiment performs image recording on a sheet P having a width W1. In addition, the inkjet recording apparatus 1 in the present embodiment performs image recording on a sheet P having a width W2 greater than the width W1. In the above configuration, in a situation in which image recording is performed on multiple sheets P having the width W1, discharge disablement may occur in regions A beside a region where the multiple sheets P have passed before execution of the regular maintenance.

The inkjet recording apparatus 1 in the present embodiment performs the sheet width dependent maintenance (purging and wiping) only on respective parts of the line heads 51 (recording heads 55) that corresponds to the regions A. Such partial maintenance is executed through control on the maintenance mechanism by the control section 9 described with reference to FIG. 1. Specifically, among the first, second, and third recording heads 55*a*, 55*b*, and 55*c* of each of the line heads 51, the first and third recording heads 55*a* and 55*c* are targets for the sheet width dependent maintenance. More specifically, the sheet width dependent maintenance is performed on a part of each first recording head 55*a* that corresponds to one of the regions A and a part of each third recording head 55*c* that corresponds to the other of the regions A.

The sheet width dependent maintenance is executed in a situation in which image recording is to be performed on a sheet P (next recording target sheet) having the width W2 after image recording is performed on a predetermined number or more (100 in the present embodiment) of sheets P having the width W1, similarly to the configuration in the first embodiment. The sheet width dependent maintenance is performed prior to image recording on the sheet P having the width W2.

Figure 17:
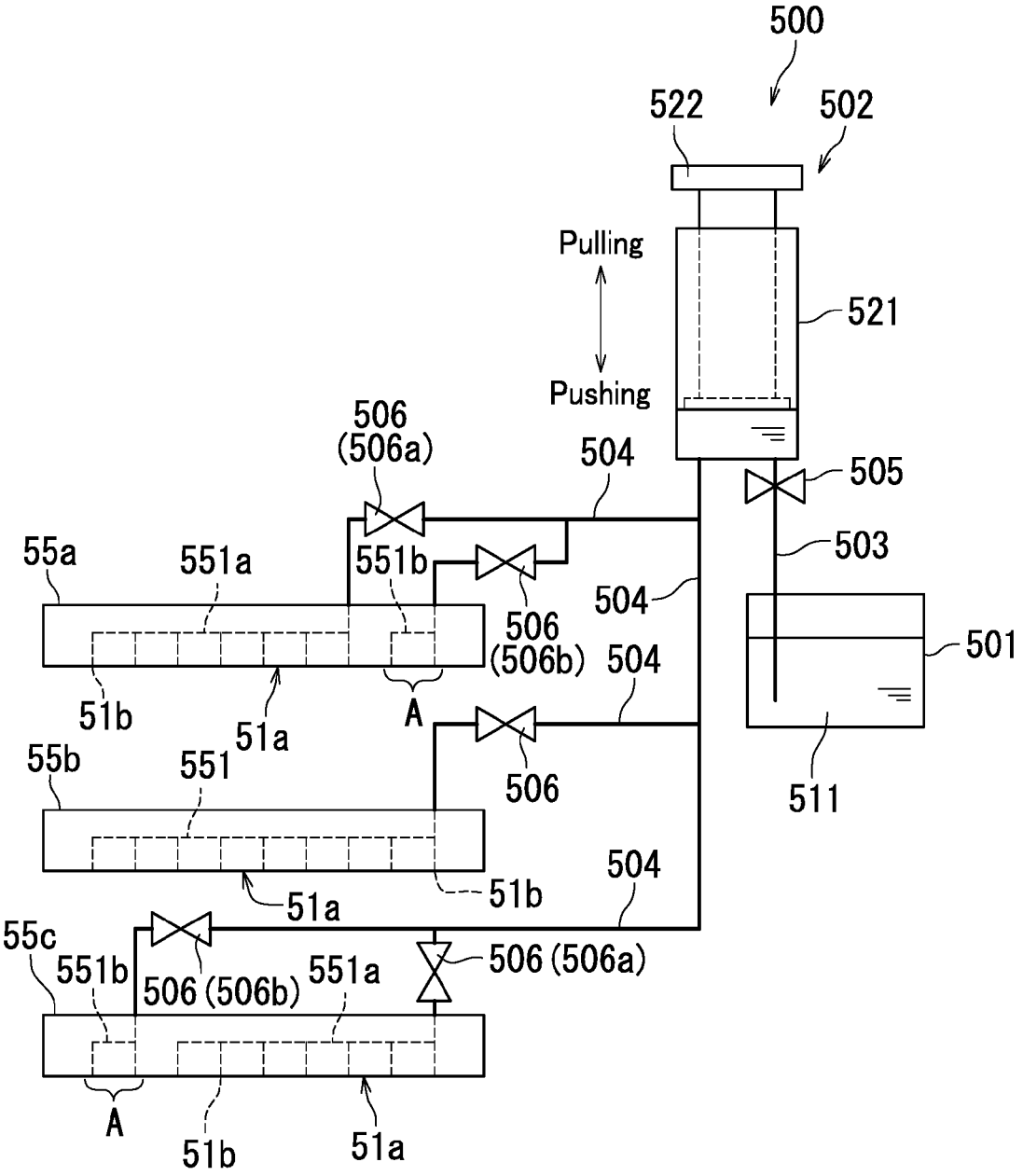
FIG. 17 illustrates structure of an ink supplying mechanism according to the second embodiment.

FIG. 17 illustrates structure of an ink supplying mechanism 500 according to the second embodiment. Specifically, FIG. 17 illustrates the ink supplying mechanism 500 for supplying an ink of any one of the colors. The inkjet recording apparatus 1 in the second embodiment includes the ink supplying mechanism 500 illustrated in FIG. 17 for each of the colors of black, cyan, magenta, and yellow. The control section 9 illustrated in FIG. 1 controls the ink supplying mechanisms 500.

As illustrated in FIG. 17, in the present embodiment, micro flow channel in the interior of each of the first and third recording heads 55*a* and 55*c* is divided into a first micro flow channel 551*a* and a second micro flow channel 551*b*. In the above configuration, the first and third recording heads 55*a* and 55*c* each have the first micro flow channel 551*a* and the second micro flow channel 551*b*. The second micro flow channel 551*b* is in communication with the nozzle orifices 51*b* located in a corresponding one of the regions A described with reference to FIG. 16.

The ink supplying mechanism 500 includes the ink tank 501 and the pump mechanism 502. The ink supplying mechanism 500 further includes the first flow channel 503 and the second flow channel 504. The first flow channel 503 connects the ink tank 501 to the pump mechanism 502. The second flow channel 504 connects each of the first, second, and third recording heads 55*a*, 55*b*, and 55*c* to the pump mechanism 502. The ink supplying mechanism 500 includes one first solenoid valve 505 and five second solenoid valves 506. The first solenoid valve 505 that is an example of an inflow switching valve is disposed in the first flow channel 503. The five second solenoid valves 506 that are examples of outflow switching valves are disposed in the second flow channel 504.

Specifically, a portion of the second flow channel 504 that is connected to the first recording head 55*a* branches into a portion connected to the inflow port of the first micro flow channel 551*a* and a portion connected to the inflow port of the second micro flow channel 551*b*. Similarly, a portion of the second flow channel 504 that is connected to the third recording head 55*c* branches into a portion connected to the inflow port of the first micro flow channel 551*a* and a portion connected to the inflow port of the second micro flow channel 551*b*. The five second solenoid valves 506 includes two second solenoid valves 506*a* and two second solenoid valves 506*b*. The two second solenoid valves 506*a* are arranged for the respective first micro flow channels 551*a* of the first and third recording heads 55*a* and 55*c*. The two second solenoid valves 506*b* are arranged for the respective second micro flow channels 551*b* of the first and third recording heads 55*a* and 55*c*.

In the sheet width dependent maintenance (purging), the ink 511 is contained in the cylinder 521. The first solenoid valve 505 is closed, and the two second solenoid valves 506*b* are opened among the five second solenoid valves 506. In other words, the cylinder 521 is in communication with the inflow ports of the two second micro flow channels 551*b*. The piston 522 performs pushing in this state. As a result, the ink 511 contained in the cylinder 521 is supplied to each of the second micro flow channels 551*b* through the second flow channel 504. In the above configuration, at least the ink 511 present in each of the micro flow channels 551*b* is forcedly extruded out (purged) from nozzle orifices 51*b* located in the regions A.

FIGS. 18A-24B each illustrate operation of a wiper blade 81 according to the second embodiment. Specifically, FIGS. 18A-24B each illustrate the wiper blade 81 in the sheet width dependent maintenance (wiping). More specifically, FIGS. 18A, 19A, 20A, 21A, 22A, 23A, and 24A each illustrate the operation of a wiper blade 81 that corresponds to a first recording head 55*a*. FIGS. 18B, 19B, 20B, 21B, 22B, 23B, and 24B each illustrate the operation of a wiper blade 81 that corresponds to a third recording head 55*c*. A wiper blade 81 that corresponds to a second recording head 55*b* performs the same operation as the respective wiper blades 81 that correspond to the first and third recording heads 55*a* and 55*c*. The operation of each of the wiper blades 81 illustrated in FIGS. 18A-24B are performed through control on the wiping unit 8 by the control section 9 illustrated in FIG. 1.

When purging is performed in the sheet width dependent maintenance, in the second embodiment, the ink 511*a* is extruded from portions of the respective nozzle surfaces 51*a* of the first and third recording heads 55*a* and 55*c* that correspond to the regions A. In the above configuration, as illustrated in FIGS. 18A and 18B, part of the purged ink 511*a* remains at a part of each nozzle surface 51*a* of the first and third recording heads 55*a* and 55*c*.

Figure 18A:
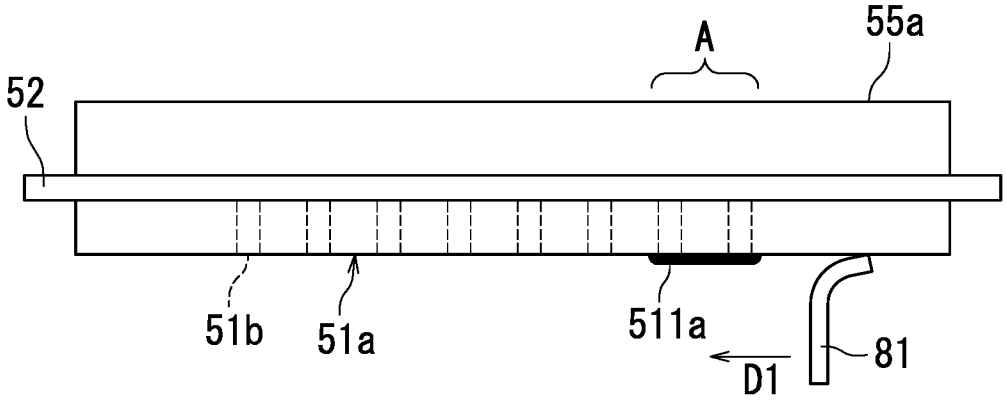
FIGS. 18A and 18B each illustrate operation of a wiper blade according to the second embodiment.
Figure 18B:
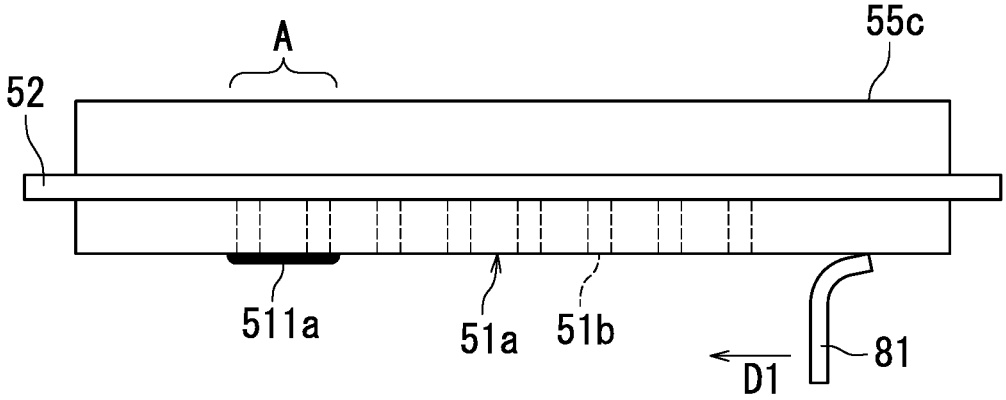
Figure 19A:
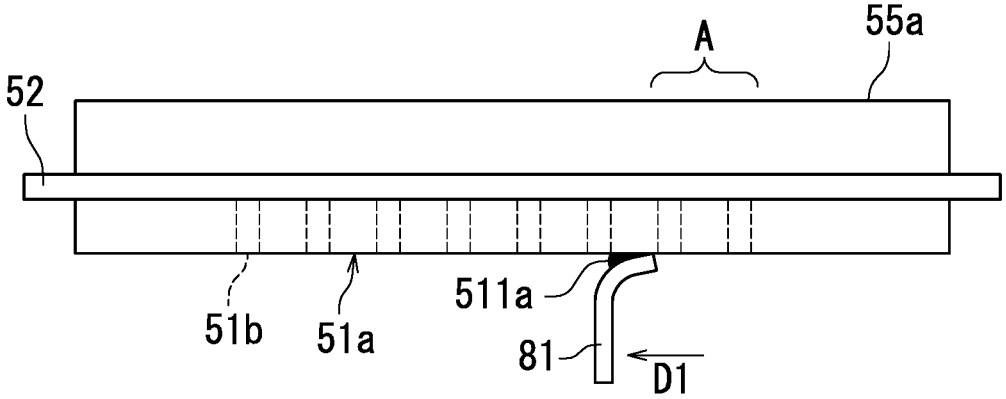
FIGS. 19A and 19B each illustrate the operation of the wiper blade according to the second embodiment.
Figure 19B:
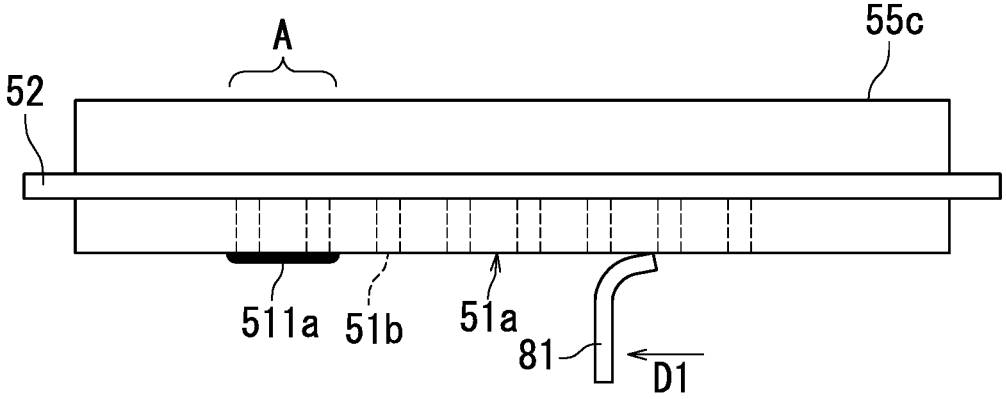

In wiping, as illustrated in FIGS. 18A and 18B, the wiper blades 81 are first pushed against the corresponding nozzle surfaces 51*a* of the first and third recording heads 55*a* and 55*c* so that the wiper blade 81 corresponding to the first recording head 55*a* wipes a part of the nozzle surface 51*a* that corresponds to one of the regions A. Then, as illustrated in FIGS. 19A and 19B, the wiper blades 81 move in the main scanning direction D1 while being pushed against the corresponding nozzle surfaces 51*a* so that the wiper blade 81 corresponding to the first recording head 55*a* wipes the part of the nozzle surface 51*a* that corresponds to the region A. Through the movement of the wiper blades 81, the purged ink 511*a* remaining on the nozzle surface 51*a* of the first recording head 55*a* is wiped off by the wiper blade 81. As a result, the purged ink 511*a* flows down along the wiper blade 81 from the nozzle surface 51*a* of the first recording head 55*a*.

Figure 20A:
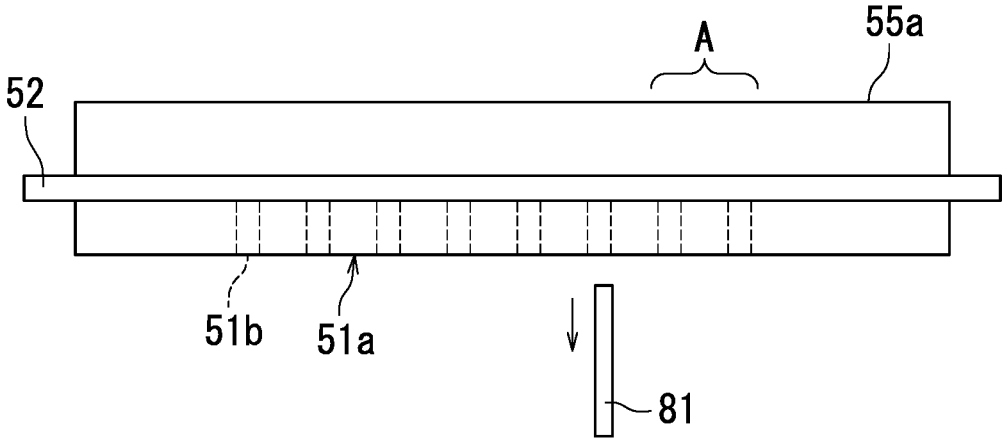
FIGS. 20A and 20B each illustrate the operation of the wiper blade according to the second embodiment.
Figure 20B:
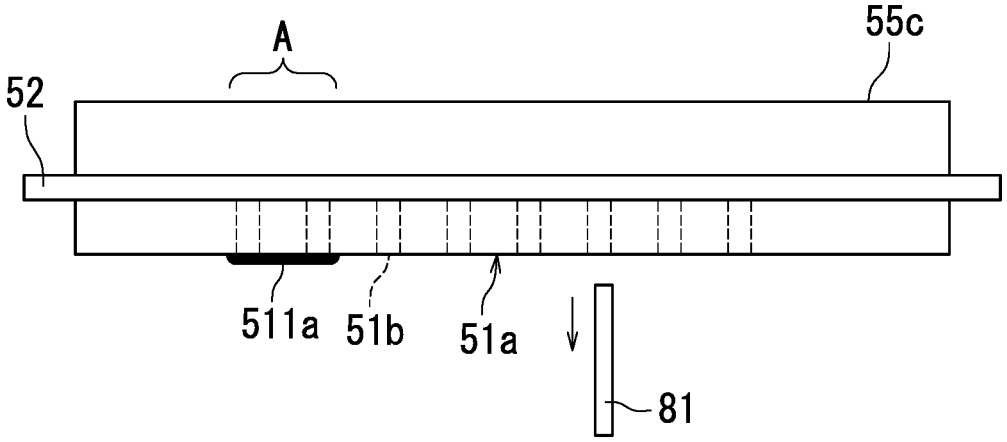

As described with reference to FIGS. 8 and 9, the wiping unit 8 then transitions from the second state to the first state. As a result, as illustrated in FIGS. 20A and 20B, the wiper blades 81 are lowered from the corresponding nozzle surfaces 51*a*. In other words, the wiper blades 81 are separate from the respective nozzle surfaces 51*a*.

Figure 21A:
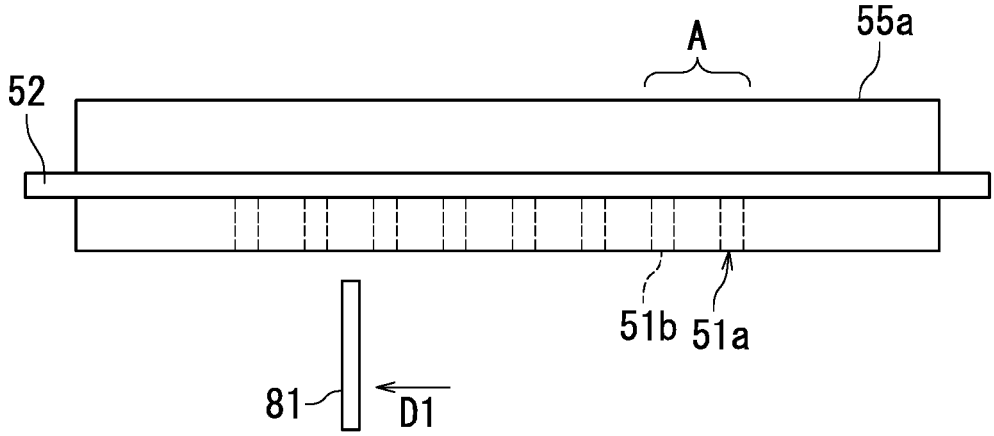
FIGS. 21A and 21B each illustrate the operation of the wiper blade according to the second embodiment.
Figure 21B:
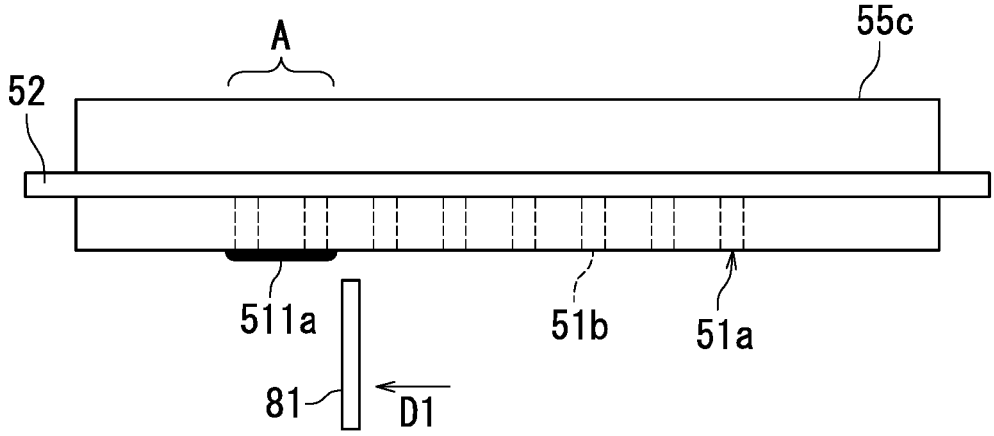

As illustrated in FIGS. 21A and 21B, the wiper blades 81 next move in the main scanning direction D1 so that the wiper blade 81 corresponding to the third recording head 55*c* moves to a location before a part of the nozzle surface 51*a* of the third recording head 55*c* that corresponds to the other region A.

Figure 22A:
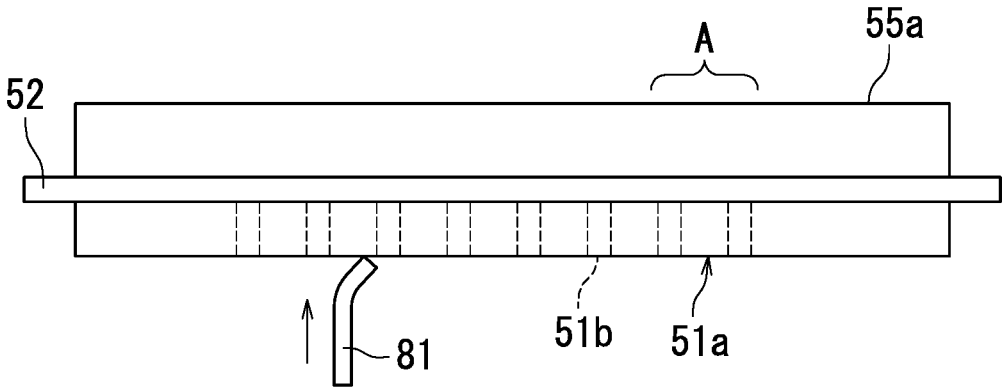
FIGS. 22A and 22B each illustrate the operation of the wiper blade according to the second embodiment.
Figure 22B:
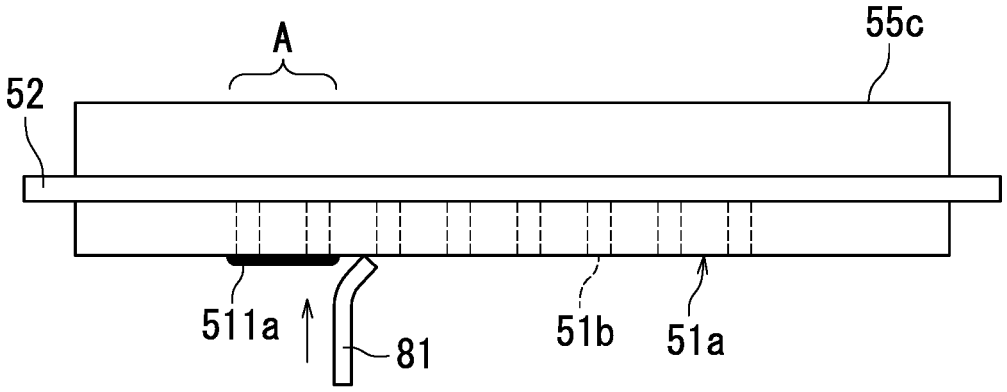

The wiping unit 8 then transitions from the first state to the second state, as described with reference to FIGS. 8 and 9. As a result, as illustrated in FIGS. 22A and 22B, the wiper blades 81 are raised and pushed against the respective nozzle surfaces 51*a*.

Figure 23A:
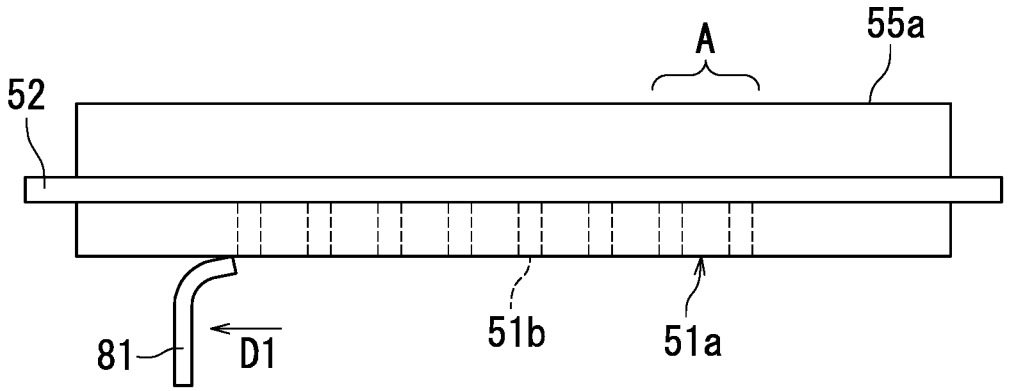
FIGS. 23A and 23B each illustrate the operation of the wiper blade according to the second embodiment.
Figure 23B:
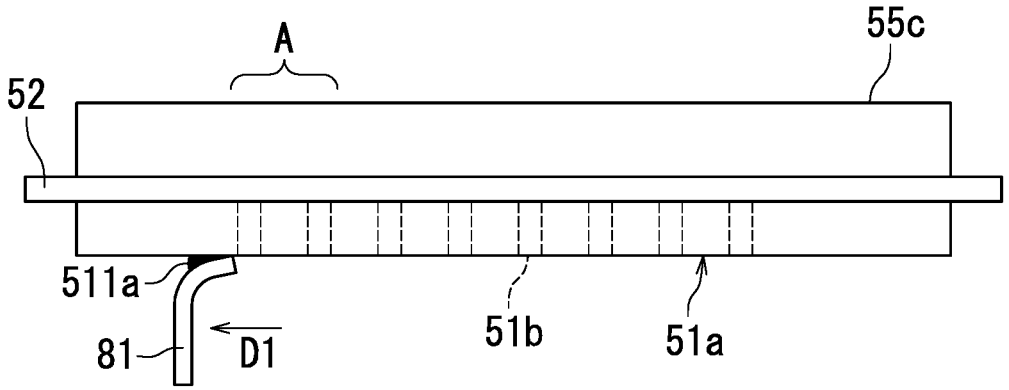

Then, as illustrated in FIGS. 23A and 23B, the wiper blades 81 move in the main scanning direction D1 while being pushed against the corresponding nozzle surfaces 51*a* so that the wiper blade 81 corresponding to the third recording head 55*c* wipes a part of the nozzle surface 51*a* of the third recording head 55*c* that corresponds to the other region A. Through the movement of the wiper blades 81, the purged ink 511*a* remaining on the nozzle surface 51*a* of the third recording head 55*c* is wiped off by the wiper blade 81. As a result, the purged ink 511*a* flows down along the wiper blade 81 from the nozzle surface 51*a* of the third recording head 55*c*.

Figure 24A:
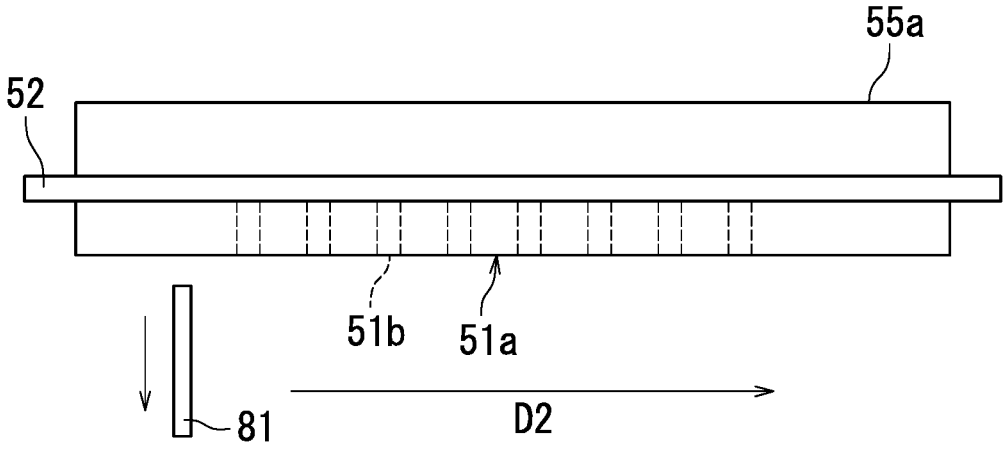
FIGS. 24A and 24B each illustrate the operation of the wiper blade according to the second embodiment.
Figure 24B:
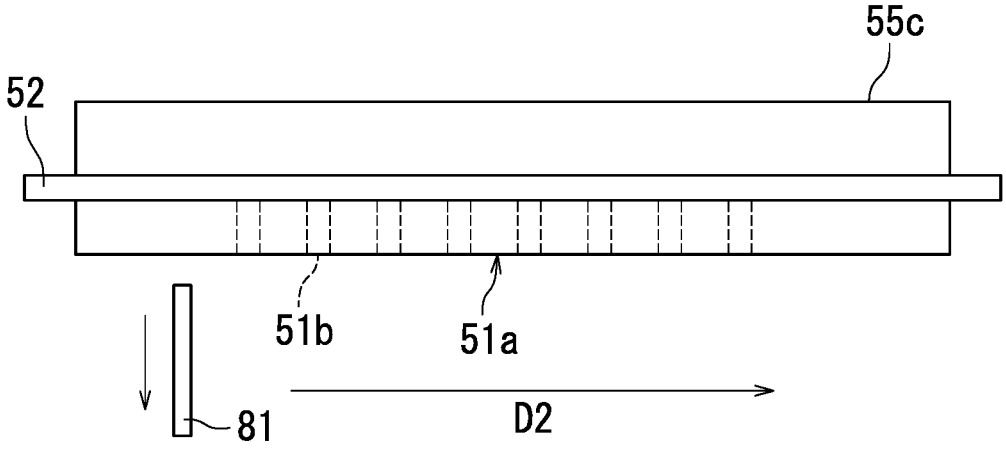

When wiping ends, the wiping unit 8 transitions from the second state to the first state, as described with reference to FIGS. 8 and 9. As a result, as illustrated in FIGS. 24A and 24B, the wiper blades 81 are lowered from the corresponding nozzle surfaces 51*a*. In other words, the wiper blades 81 are separate from the respective nozzle surfaces 51*a*. The wiper blades 81 then move in the return direction D2 to return to the original positions indicated in FIG. 8.

The present embodiment describes, but is not limited to, a configuration in which each of the micro flow channels of the first and third recording heads 55*a* and 55*c* is divided into two micro flow channels 551*a* and 551*b* according to the two width types (W1 and W2) of sheets P. The present disclosure is applicable to a configuration using sheets P of three or more width types. In a situation in which the present disclosure is applied to a configuration using sheets P of three or more width types, each of the micro flow channels of the first and third recording heads 55*a* and 55*c* is divided into three or more micro flow channels according to the number of the width types of the sheets P. A second solenoid valve 506 is provided in each of the divided flow channels.

As has been described so far, in the present embodiment, the sheet width dependent maintenance is performed on respective parts of the line heads 51 (recording heads 55) in correspondence with the difference in width between the next recording target sheet P and a sheet P subjected to image recording prior to the next recording target sheet P. In the above configuration, even in a situation in which the width of the next recording target sheet P is greater than the width of the sheet P previously subjected to image recording, an image formed on the next recording target sheet P is unlikely to include a white line, similarly to the configuration in the first embodiment. Thus, reduction in image quality can be prevented.

Further in the present embodiment, ink is extruded from a portion of the nozzle orifices 51*b* in the line heads 51 (recording heads 55) in correspondence with the difference in width between the next recording target sheet P and the sheet P subjected to image recording prior to the next recording target sheet P. In the above configuration, the amount of the ink 511 consumed in the sheet width dependent maintenance can be reduced.

Yet in the present embodiment, the wiper blades 81 wipe respective parts of the nozzle surfaces 51*a* of the line heads 51 (recording heads 55) in correspondence with the difference in width between the next recording target sheet P and the sheet P subjected to image recording prior to the next recording target sheet P. In the above configuration, the amount of movement of the wiper blades 81 in a state being pushed against the respective nozzle surfaces 51*a* can be reduced in the sheet width dependent maintenance. Thus, abrasion of the wiper blades 81 can be reduced. The lifetime of the wiper blades 81 can be accordingly extended.

The present embodiment describes, but is not limited to, a configuration in which the wiper blades 81 wipe (clean) respective parts of the nozzle surfaces 51*a* in the sheet width dependent maintenance. Alternatively, the wiper blades 81 may wipe the entire parts of the respective nozzle surfaces 51*a* in the sheet width dependent maintenance.

The embodiments of the present disclosure have been described so far with reference to the drawings. The present disclosure is not limited to the above embodiments, and various alterations may be made without departing from the spirit and the scope of the present disclosure.

The embodiments of the present embodiment describe, but are not limited to, a configuration in which the line heads 51 is constituted by the three recording heads 55. Alternatively, the line heads 51 may be constituted by one, two, or four or more recording heads.

The embodiments of the present disclosure are applied to an inkjet recording apparatus capable of performing full-color image recording. However, the present disclosure may be applicable to inkjet recording apparatuses that perform monochrome image recording.

Respective matter described in the embodiments of the present disclosure may be appropriately combined together.

What is claimed is:

1. An inkjet recording apparatus that performs image recording on a recording medium by discharging ink droplets, comprising:

a conveyance section configured to convey a recording medium in a first direction;

a recording head configured to discharge ink droplets toward the recording medium while the conveyance section conveys the recording medium;

a maintenance mechanism configured to perform maintenance on the recording head; and a control section configured to control the maintenance mechanism, the control section causing the maintenance mechanism to operate upon determination that a width of a next recording target recording medium in a second direction perpendicular to the first direction is greater than a width of a recording medium subjected to image recording prior to the next recording target recording medium in the second direction.

2. The inkjet recording apparatus according to claim 1, wherein the control section causes the maintenance mechanism to operate upon determination that image recording has been performed on a predetermined number or more of recording mediums having a width in the second direction smaller than the width of the next recording target recording medium in the second direction prior to the next recording target recording medium.

3. The inkjet recording apparatus according to claim 1, wherein the control section controls the maintenance mechanism to perform maintenance on a part of the recording head in correspondence with a difference in width in the second direction between the next recording target recording medium and the recording medium subjected to image recording prior to the next recording target recording medium.

4. The inkjet recording apparatus according to claim 3, wherein the recording head has a nozzle surface having a plurality of nozzle orifices, the maintenance mechanism includes a supply mechanism that supplies ink to the recording head, and the control section controls the supply mechanism to purge the ink from a portion of the nozzle orifices in correspondence with the difference in width in the second direction.

5. The inkjet recording apparatus according to claim 4, wherein the maintenance mechanism further includes a wiper blade that wipes the nozzle surface, the control section controls the wiper blade to wipe a part of the nozzle surface in correspondence with the difference in width in the second direction after controlling the supply mechanism to purge the ink from some of the nozzle orifices.

6. A method for performing maintenance on a recording head that discharges ink droplets toward a recording medium being conveyed in a first direction, comprising:

determining whether or not a width of a next recording target recording medium in a second direction perpendicular to the first direction is greater than a width of a recording medium in the second direction subjected to image recording prior to the next recording target recording medium; and upon determination that the width of the next recording target recording medium is greater than the width of the recording medium subjected to image recording prior to the next recording target recording medium, performing maintenance on the recording head.

7. A method for performing maintenance on a recording head that discharges ink droplets toward a recording medium being conveyed in a first direction, comprising:

determining whether or not a width of a next recording target recording medium in a second direction perpendicular to the first direction is greater than a width of a recording medium in the second direction subjected to image recording prior to the next recording target recording medium;

upon determination that the width of the next recording target recording medium is greater than the width of the recording medium subjected to image recording prior to the next recording target recording medium, determining whether or not image recording has been performed on a predetermined number or more of recording mediums having a width in the second direction smaller than the width of the next recording target recording medium prior to the next recording target recording medium; and upon determination that image recording has been performed on the predetermined number or more of recording mediums having the width in the second direction smaller than the width of the next recording target recording medium prior to the next recording target recording medium, performing maintenance on the recording head.

* * * * *